US011354972B2

(12) United States Patent
Chun et al.

(10) Patent No.: US 11,354,972 B2
(45) **Date of Patent: *Jun. 7, 2022**

(54) ELECTRONIC TABLE GAME POKER SYSTEM AND METHODS

(71) Applicant: Fresh Idea Global Limited

(72) Inventors: Jay Chun, Hong Kong (HK); Daryn Kiely, Henderson, NV (US)

(73) Assignee: Fresh Idea Global Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 16/505,558

(22) Filed: Jul. 8, 2019

(65) Prior Publication Data

US 2020/0005584 A1 Jan. 2, 2020

Related U.S. Application Data

(63) Continuation of application No. 15/231,693, filed on Aug. 19, 2016, now Pat. No. 10,366,563.

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *G07F 17/322* (2013.01); *A63F 1/00* (2013.01); *A63F 3/00157* (2013.01); (Continued)

(58) Field of Classification Search

None

See application file for complete search history.

(56) References Cited

U.S. PATENT DOCUMENTS

| | | | |
|---|---|---|---|
| 629,672 | A | 7/1899 | Fadum |
| D72,257 | S | 3/1927 | Haunz |

(Continued)

FOREIGN PATENT DOCUMENTS

| | | |
|---|---|---|
| CN | 101244335 | 8/2008 |
| CN | 101513571 | 8/2009 |

(Continued)

OTHER PUBLICATIONS

Office Action for U.S. Appl. No. 13/948,101, dated Dec. 16, 2013.

(Continued)

*Primary Examiner* — Damon J Pierce

(57) ABSTRACT

Gaming table systems include electronic gaming tables, gaming terminals, and a system server. A system or table can be configured to administer a live wager-based table game involving an initial shared hand that is shared by multiple live players. Each player can make different live game decisions regarding discarding physical playing items from the initial shared hand, and game outcomes include final hands that vary by player depending upon the different decisions. The live table game can be draw poker, which can involve dealing five physical cards face up for the initial shared hand and five additional cards face down for a first set of replacement cards before any live game player decisions. A second set of replacement cards can provide a second play from the same initial shared hand. Methods of providing the draw poker game can include preventing further user inputs prior to revealing the face down cards.

20 Claims, 12 Drawing Sheets

(52) U.S. Cl.
CPC ..... *G07F 17/3209* (2013.01); *G07F 17/3211* (2013.01); *G07F 17/3225* (2013.01); *G07F 17/3246* (2013.01); *G07F 17/3276* (2013.01); *G07F 17/3293* (2013.01); *A63F 2001/005* (2013.01)

(56) References Cited

U.S. PATENT DOCUMENTS

| | | | |
|---|---|---|---|
| 2,302,333 | A | 11/1942 | Linke |
| D141,237 | S | 5/1945 | Gauvreau |
| D150,824 | S | 9/1948 | Buckner |
| D170,040 | S | 7/1953 | Altemiller |
| D246,916 | S | 1/1978 | Cheng |
| D259,847 | S | 7/1981 | Hamby |
| D268,368 | S | 3/1983 | Moss |
| D280,477 | S | 9/1985 | Petrick |
| 4,856,787 | A | 8/1989 | Itkis |
| 5,031,913 | A | 7/1991 | Hirosumi |
| D321,614 | S | 11/1991 | Liptak |
| 5,083,271 | A | 1/1992 | Thacher et al. |
| 5,347,061 | A | 9/1994 | Harandi et al. |
| 5,472,194 | A | 12/1995 | Breeding et al. |
| 5,605,334 | A | 2/1997 | McCrea |
| 5,707,061 | A | 1/1998 | Ikeda et al. |
| 5,762,552 | A | 6/1998 | Vuong |
| 5,768,382 | A | 6/1998 | Schneier et al. |
| 5,823,873 | A | 10/1998 | Moody |
| 5,851,011 | A | 12/1998 | Lott |
| 5,917,725 | A | 6/1999 | Thacher et al. |
| 5,970,143 | A | 10/1999 | Schneier et al. |
| 6,165,069 | A | 12/2000 | Sines et al. |
| D438,260 | S | 2/2001 | Isetani |
| D438,404 | S | 3/2001 | Topper |
| 6,331,148 | B1 | 12/2001 | Krause |
| 6,361,044 | B1 | 3/2002 | Block |
| 6,394,901 | B1 | 5/2002 | Marta |
| 6,508,709 | B1 | 1/2003 | Karmarkar |
| 6,652,378 | B2 | 11/2003 | Cannon |
| 6,671,358 | B1 | 12/2003 | Seidman et al. |
| 6,886,829 | B2 | 5/2005 | Hessing et al. |
| 6,991,544 | B2 | 1/2006 | Soltys et al. |
| 7,008,322 | B1 | 3/2006 | Suzuki et al. |
| 7,040,982 | B1 | 5/2006 | Jarvis |
| D539,854 | S | 4/2007 | Luciano |
| 7,206,762 | B2 | 4/2007 | Sireau |
| 7,233,922 | B2 | 6/2007 | Asher |
| D546,596 | S | 7/2007 | McDermott |
| D557,348 | S | 12/2007 | Gutknecht |
| 7,553,233 | B2 | 6/2009 | Jarvis et al. |
| D596,678 | S | 7/2009 | Myers |
| 7,566,268 | B2 | 7/2009 | Asher |
| 7,566,270 | B2 | 7/2009 | Amaitis |
| 7,604,537 | B2 | 10/2009 | Amaitis |
| 7,637,506 | B2 | 12/2009 | Naicker |
| 7,684,874 | B2 | 3/2010 | Schlottmann et al. |
| 7,690,996 | B2 | 4/2010 | Iddings et al. |
| D615,319 | S | 5/2010 | Tuszkiewicz |
| 7,711,628 | B2 | 5/2010 | Davie |
| 7,727,060 | B2 | 6/2010 | Mills |
| 7,731,586 | B2 | 6/2010 | Letovsky et al. |
| 7,783,542 | B2 | 8/2010 | Horowitz |
| 7,783,552 | B2 | 8/2010 | Assia |
| 7,798,895 | B2 | 9/2010 | Jubinville et al. |
| D641,427 | S | 7/2011 | Lin |
| D645,910 | S | 9/2011 | Foster |
| 8,052,526 | B2 | 11/2011 | Abbott et al. |
| 8,070,583 | B2 | 12/2011 | Baerlocher et al. |
| 8,150,157 | B2 | 4/2012 | Downs et al. |
| 8,257,166 | B2 | 9/2012 | Kido |
| 8,262,090 | B2 | 9/2012 | Soltys et al. |
| 8,272,892 | B2 | 9/2012 | McNeely et al. |
| 8,282,489 | B2 | 10/2012 | Azerina et al. |
| 8,348,278 | B2 | 1/2013 | Tseng |
| 8,444,148 | B1 | 5/2013 | Tseng |
| 8,469,788 | B2 | 6/2013 | Carpenter et al. |
| 8,590,895 | B2 | 11/2013 | Kwon |
| 8,684,830 | B1 | 4/2014 | Chun |
| 8,808,077 | B1 | 8/2014 | Chun |
| 8,920,229 | B1 | 12/2014 | Chun |
| 9,292,996 | B2 | 3/2016 | Davis et al. |
| 9,311,773 | B2 | 4/2016 | Chung |
| 9,449,461 | B1 | 9/2016 | Barksdale |
| 9,592,450 | B2 | 3/2017 | Chun |
| 9,595,166 | B2 | 3/2017 | Chun |
| 9,779,580 | B2 | 10/2017 | Jones |
| 9,858,752 | B2 | 1/2018 | Montgomery |
| 9,931,562 | B2 | 4/2018 | Chun |
| 9,940,782 | B2 | 4/2018 | Chun |
| RE46,826 | E | 5/2018 | Hill |
| 10,013,847 | B2 | 7/2018 | Chun |
| 10,147,269 | B2 | 12/2018 | Chun |
| D852,890 | S | 7/2019 | Ross |
| 10,688,383 | B2 | 6/2020 | Chun |
| 2002/0002073 | A1 | 1/2002 | Montgomery |
| 2002/0094869 | A1 | 7/2002 | Harkham |
| 2002/0147042 | A1 | 10/2002 | Shinners et al. |
| 2002/0151366 | A1 | 10/2002 | Walker et al. |
| 2003/0070178 | A1 | 4/2003 | Boyd |
| 2003/0137110 | A1 | 7/2003 | Huard et al. |
| 2003/0195841 | A1 | 10/2003 | Ginsberg |
| 2004/0121839 | A1 | 6/2004 | Web |
| 2004/0152498 | A1 | 8/2004 | Kaminkow |
| 2004/0204232 | A1 | 10/2004 | Asher |
| 2005/0043094 | A1 | 2/2005 | Nguyen et al. |
| 2005/0165669 | A1 | 7/2005 | Montanaro |
| 2005/0197938 | A1 | 9/2005 | Davie |
| 2005/0197948 | A1 | 9/2005 | Davie |
| 2006/0025221 | A1 | 2/2006 | Jain |
| 2006/0058082 | A1 | 3/2006 | Crawford et al. |
| 2006/0058083 | A1 | 3/2006 | Crawford et al. |
| 2006/0058084 | A1 | 3/2006 | Crawford et al. |
| 2006/0058085 | A1 | 3/2006 | White et al. |
| 2006/0058086 | A1 | 3/2006 | White et al. |
| 2006/0058087 | A1 | 3/2006 | White et al. |
| 2006/0058088 | A1 | 3/2006 | Crawford et al. |
| 2006/0058089 | A1 | 3/2006 | White et al. |
| 2006/0058090 | A1 | 3/2006 | Crawford et al. |
| 2006/0058091 | A1 | 3/2006 | Crawford et al. |
| 2006/0058092 | A1 | 3/2006 | Crawford et al. |
| 2006/0058093 | A1 | 3/2006 | White et al. |
| 2006/0066052 | A1 | 3/2006 | White et al. |
| 2006/0068498 | A1 | 3/2006 | White et al. |
| 2006/0068864 | A1 | 3/2006 | White et al. |
| 2006/0068865 | A1 | 3/2006 | White et al. |
| 2006/0068866 | A1 | 3/2006 | White et al. |
| 2006/0068868 | A1 | 3/2006 | Crawford et al. |
| 2006/0068869 | A1 | 3/2006 | White et al. |
| 2006/0068870 | A1 | 3/2006 | Crawford et al. |
| 2006/0068871 | A1 | 3/2006 | Crawford et al. |
| 2006/0068879 | A1 | 3/2006 | Crawford et al. |
| 2006/0068899 | A1 | 3/2006 | White et al. |
| 2006/0094493 | A1 | 5/2006 | Kido |
| 2006/0100019 | A1 | 5/2006 | Hornik et al. |
| 2006/0105839 | A1 | 5/2006 | Graeve |
| 2006/0217199 | A1 | 9/2006 | Adcox et al. |
| 2006/0264252 | A1 | 11/2006 | White et al. |
| 2006/0287066 | A1 | 12/2006 | Crawford et al. |
| 2006/0287067 | A1 | 12/2006 | White et al. |
| 2006/0287097 | A1 | 12/2006 | Moshal |
| 2006/0287101 | A1 | 12/2006 | Crawford et al. |
| 2006/0287102 | A1 | 12/2006 | White et al. |
| 2006/0287103 | A1 | 12/2006 | Crawford et al. |
| 2006/0287104 | A1 | 12/2006 | White et al. |
| 2007/0015583 | A1 | 1/2007 | Tran |
| 2007/0032283 | A1 | 2/2007 | Chun |
| 2007/0060259 | A1 | 3/2007 | Pececnik |
| 2007/0087832 | A1 | 4/2007 | Abbott et al. |
| 2007/0090595 | A1 | 4/2007 | Csikos |
| 2007/0129138 | A1 | 6/2007 | Amaitis |
| 2007/0178955 | A1 | 8/2007 | Mills |
| 2007/0259709 | A1 | 11/2007 | Kelly et al. |
| 2008/0045344 | A1 | 2/2008 | Schlottmann et al. |
| 2008/0081685 | A1 | 4/2008 | Naftaly |
| 2008/0102916 | A1 | 5/2008 | Kovacs |

(56) References Cited

U.S. PATENT DOCUMENTS

| | | | |
|---|---|---|---|
| 2008/0108404 | A1 | 5/2008 | Iddings et al. |
| 2008/0108436 | A1 | 5/2008 | Oberberger |
| 2008/0113767 | A1 | 5/2008 | Nguyen et al. |
| 2008/0153571 | A1 | 6/2008 | Okada |
| 2008/0200242 | A1 | 8/2008 | Ginsberg |
| 2008/0220837 | A1 | 9/2008 | Yoshizawa |
| 2008/0248849 | A1 | 10/2008 | Lutnick et al. |
| 2008/0248864 | A1 | 10/2008 | Toyoda |
| 2008/0318651 | A1 | 12/2008 | Gross |
| 2009/0005165 | A1 | 1/2009 | Arezina |
| 2009/0121434 | A1 | 5/2009 | Baerlocher |
| 2009/0124323 | A1 | 5/2009 | Dunn et al. |
| 2009/0131151 | A1 | 5/2009 | Harris et al. |
| 2009/0189351 | A1 | 7/2009 | Baerlocher |
| 2009/0197676 | A1 | 8/2009 | Baerlocher |
| 2009/0215529 | A1 | 8/2009 | Inamura |
| 2009/0275376 | A1 | 11/2009 | Anderson |
| 2009/0280904 | A1 | 11/2009 | Nicely et al. |
| 2009/0291762 | A1 | 11/2009 | Walter |
| 2009/0325686 | A1 | 12/2009 | Davis et al. |
| 2010/0087241 | A1 | 4/2010 | Nguyen et al. |
| 2010/0150460 | A1 | 4/2010 | Makhoul et al. |
| 2010/0234089 | A1 | 9/2010 | Saffari |
| 2010/0234099 | A1 | 9/2010 | Rasmussen |
| 2010/0331085 | A1 | 12/2010 | Nagano |
| 2011/0018194 | A1 | 1/2011 | Nicely et al. |
| 2011/0111833 | A1 | 5/2011 | Nordahl |
| 2011/0294561 | A1 | 12/2011 | Shaw et al. |
| 2011/0300917 | A1 | 12/2011 | Hill |
| 2012/0049447 | A1 | 3/2012 | Klein |
| 2012/0049455 | A1 | 3/2012 | Yap et al. |
| 2012/0083909 | A1 | 4/2012 | Carpenter et al. |
| 2012/0122564 | A1 | 5/2012 | Kovacs |
| 2012/0214575 | A1 | 8/2012 | Amaitis et al. |
| 2012/0252564 | A1 | 10/2012 | Moore et al. |
| 2012/0264496 | A1 | 10/2012 | Behrman |
| 2012/0329551 | A1 | 12/2012 | Arerina et al. |
| 2013/0005456 | A1 | 1/2013 | Okujo et al. |
| 2013/0079147 | A1 | 3/2013 | Merati |
| 2013/0116031 | A1 | 5/2013 | Carpenter et al. |
| 2013/0134672 | A1 | 5/2013 | Okuaki |
| 2013/0225276 | A1 | 8/2013 | Au-Yeung |
| 2013/0244765 | A1 | 9/2013 | Arnone et al. |
| 2013/0260863 | A1 | 10/2013 | Lee |
| 2013/0281197 | A1 | 10/2013 | Carpenter et al. |
| 2013/0288764 | A1 | 10/2013 | Chun |
| 2013/0288779 | A1 | 10/2013 | Chun |
| 2013/0296031 | A1 | 11/2013 | Arnone et al. |
| 2013/0341862 | A1 | 12/2013 | Tokue |
| 2014/0094256 | A1 | 4/2014 | Hilbert |
| 2014/0094298 | A1 | 4/2014 | Lyons |
| 2014/0162758 | A1 | 6/2014 | Pececnik |
| 2014/0187306 | A1 | 7/2014 | Nordahl |
| 2014/0256392 | A1 | 9/2014 | Jones |
| 2014/0256411 | A1 | 9/2014 | Basallo |
| 2014/0274252 | A1 | 9/2014 | Chun |
| 2014/0274253 | A1 | 9/2014 | Chun |
| 2014/0312567 | A1 | 10/2014 | Chun |
| 2015/0019744 | A1 | 1/2015 | Bourenkov |
| 2015/0024818 | A1 | 1/2015 | Chun |
| 2015/0116410 | A1 | 4/2015 | Armbruster et al. |
| 2015/0161851 | A1 | 6/2015 | Naicker |
| 2015/0332552 | A1 | 11/2015 | Chun |
| 2016/0292954 | A1 | 10/2016 | Sugai et al. |
| 2017/0161988 | A1 | 6/2017 | Nguyen |
| 2017/0161993 | A1 | 6/2017 | Nguyen |
| 2018/0315272 | A1 | 11/2018 | Chun |

FOREIGN PATENT DOCUMENTS

| | | | |
|---|---|---|---|
| CN | 102580306 | | 7/2012 |
| EP | 1939826 | A2 | 7/2008 |
| TW | 201138907 | A1 | 11/2011 |

OTHER PUBLICATIONS

Cantor Fitzgerald Hopes to Bring Spread Betting to Las Vegas Casinos, Dec. 14, 2009.
Financial Spread Betting, Apr. 26, 2012.
High-Speed Traders Set Their Sights on Asia and Latin America, Aug. 12, 2010.
Office Action for U.S. Appl. No. 13/456,110, dated Jun. 11, 2013.
Final Office Action for U.S. Appl. No. 13/456,110, dated Dec. 24, 2013.
Office Action for U.S. Appl. No. 14/017,071, dated Nov. 7, 2013.
Notice of Allowance for U.S. Appl. No. 14/017,071, dated Jan. 24, 2014.
Office Action for U.S. Appl. No. 14/017,073, dated Dec. 10, 2013.
Final Office Action for U.S. Appl. No. 13/948,101, dated Apr. 23, 2014.
Notice of Allowance for U.S. Appl. No. 14/017,073, dated May 20, 2014.
Office Action for U.S. Appl. No. 14/095,882, dated Aug. 14, 2014.
Office Action for U.S. Appl. No. 13/456,110, dated Sep. 12, 2014.
Office Action for U.S. Appl. No. 13/542,446, dated Sep. 10, 2014.
Office Action for U.S. Appl. No. 14/197,683, dated Aug. 4, 2014.
Office Action for U.S. Appl. No. 14/174,701, dated Mar. 12, 2015.
Final Office Action for U.S. Appl. No. 13/542,446, dated Mar. 25, 2015.
Final Office Action for U.S. Appl. No. 13/456,110, dated Apr. 22, 2015.
Office Action for U.S. Appl. No. 13/456,110, dated Jan. 13, 2016.
Final Office Action for U.S. Appl. No. 13/542,446, dated Jan. 4, 2016.
Office Action for U.S. Appl. No. 15/094,827, dated Sep. 22, 2016.
Notice of Allowance for U.S. Appl. No. 13/456,110, dated Nov. 16, 2016.
Notice of Allowance for U.S. Appl. No. 13/542,446, dated Nov. 16, 2016.
Office Action for U.S. Appl. No. 14/692,623, dated Oct. 5, 2016.
Office Action for U.S. Appl. No. 14/318,426, dated Sep. 11, 2015.
Notice of Allowance for U.S. Appl. No. 14/318,426, dated Dec. 8, 2015.
Office Action for U.S. Appl. No. 14/508,922, dated Jan. 30, 2017.
Final Office Action for U.S. Appl. No. 14/692,623, dated Mar. 24, 2017.
Notice of Allowance for U.S. Appl. No. 14/692,623, dated Jun. 30, 2017.
Restriction Requirement for U.S. Appl. No. 14/692,623, dated Sep. 6, 2016.
Office Action for U.S. Appl. No. 15/094,827, dated Sep. 13, 2017.
SIPO of People's Republic of China, Examiner's Report and International Search Report for Macau Patent Application No. I-1385 dated May 26, 2017(with partial Translation).
Notice of Allowance for U.S. Appl. No. 14/692,623, dated Nov. 29, 2017.
Final Office Action for U.S. Appl. No. 15/441,182, dated Mar. 16, 2018.
Notice of Allowance for U.S. Appl. No. 15/094,827, dated Apr. 4, 2018.
Notice of Allowance for U.S. Appl. No. 15/691,738, dated May 23, 2018.
Office Action for U.S. Appl. No. 14/929,240, dated Jun. 1, 2018.
Office Action for U.S. Appl. No. 15/231,693, dated Jun. 22, 2018.
Office Action for U.S. Appl. No. 15/943,661, dated Jun. 29, 2018.
Office Action for U.S. Appl. No. 15/666,486 dated Jul. 27, 2018.
Office Action for U.S. Appl. No. 14/508,922, dated Aug. 31, 2018.
Office Action for U.S. Appl. No. 15/441,184, dated Jul. 3, 2018.
Final Office Action for U.S. Appl. No. 14/929,240, dated Dec. 12, 2018.
Final Office Action for U.S. Appl. No. 15/666,486, dated Dec. 31, 2018.
Office Action for U.S. Appl. No. 14/929,240, dated Apr. 5, 2019.
Final Office Action for U.S. Appl. No. 14/508,922, dated May 2, 2019.
Office Action for U.S. Appl. No. 15/666,486, dated Jun. 5, 2019.
Office Action for U.S. Appl. No. 16/167,455, dated Jun. 14, 2019.

(56) References Cited

OTHER PUBLICATIONS

Notice of Allowance for U.S. Appl. No. 16/025,994, dated Jun. 26, 2019.
Notice of Allowance for U.S. Appl. No. 14/929,240, dated Sep. 4, 2019.
Office Action for Design U.S. Appl. No. 29/667,500, dated Sep. 11, 2019.
Final Office Action for U.S. Appl. No. 15/666,486, dated Nov. 27, 2019.
Final Office Action for U.S. Appl. No. 14/508,922, dated Dec. 6, 2019.
Advisory Action for U.S. Appl. No. 15/666,486, dated Mar. 17, 2020.
Office Action for U.S. Appl. No. 15/666,486, dated Jun. 12, 2020.
Office Action for U.S. Appl. No. 16/735,685, dated Oct. 2, 2020.
Office Action for U.S. Appl. No. 15/666,486, dated Nov. 5, 2020.
Office Action for U.S. Appl. No. 16/877,232, dated Nov. 27, 2020.
Final Office Action for U.S. Appl. No. 16/735,685, dated Jan. 12, 2021.

ELECTRONIC TABLE GAME POKER SYSTEM AND METHODS

CROSS REFERENCE TO RELATED APPLICATION

This application is a continuation U.S. patent application Ser. No. 15/231,693, filed Aug. 19, 2016 and entitled "ELECTRONIC TABLE GAME POKER SYSTEM AND METHODS," which application is incorporated herein in its entirety and for all purposes.

TECHNICAL FIELD

The present invention relates generally to electronic gaming systems, and more particularly to electronic gaming table systems having automated components.

BACKGROUND

Casinos and other resorts that offer wagering games, sports books, and other similar endeavors have grown substantially in popularity and sophistication in recent years. Wagering games such as baccarat, blackjack, roulette, craps, sic-bo, and poker, among many others, are popular table games offered in such establishments. These games are traditionally administered by human dealers on physical gaming tables having a dealer surface, felt or similar table top layouts, cards, dice, chips and the like. These games can also be played on electronic gaming machines where the dealer, playing cards, chips or other gaming elements may be virtual.

Many formats for these table games involve live games against the house or other players, other formats can involve electronic and online versions. In various electronic table system arrangements, players can be at the physical gaming table and/or located remotely from but still playing at the physical gaming table. The nature of live table games can be different with respect to fully automated electronic games, however, such as where live table games often take longer to play than games on slot machines, video poker machines, and other gaming devices. In addition, a given live table game is traditionally limited to only a few players, which tends to cap the amount of excitement for any given live table game, as well as restrict the overall amount of revenue that can be generated by a given live dealer for the live table games.

While the administration of live table games and other casino endeavors have worked well in practice over many years, there is always a desire for improvement. What can be improved then are electronic wager-based gaming table systems that permit a greater amount of player participation for a given live table game.

SUMMARY

It is an advantage of the present disclosure to provide improved table gaming table systems, particularly with respect to those that allow live game play of the same shared hand by a large number of players across the system. This can be accomplished at least in part through the use of electronic gaming tables that provide live table games allowing for many different player decisions for the same shared hand. In particular, each player can be permitted to make different live game decisions independently regarding discarding physical playing items from an initial shared hand, and the outcomes of the live game play include final hands that vary by player depending upon the different live game decisions made by the multiple live players.

In various embodiments of the present disclosure, a gaming table system can include at least one or more electronic gaming tables that provide wager-based table games, a plurality of gaming terminals, and a system server. Each of the electronic gaming tables can include a physical surface adapted for the play of the live wager-based table games, a table controller adapted to control electronic gaming table functions and a table communication interface coupled to the table controller and adapted to facilitate communications between the table controller and one or more other gaming table system components. Each of the plurality of gaming terminals can include a terminal controller adapted to facilitate the play of wager-based table games thereat and a terminal communication interface coupled to the terminal controller and adapted to facilitate communications between the terminal controller and one or more other gaming table system components. The system server can be located remotely from and in communication with the one or more electronic gaming tables and the plurality of gaming terminals, with the system server being configured to facilitate provision of the live wager-based table games. In addition, the gaming table system can be configured to administer a live table game involving an initial shared hand that is shared by multiple live players playing the live table game, wherein each of the multiple live players is permitted to make different live game decisions independently regarding discarding physical playing items from the initial shared hand, and wherein the outcomes of the first live table game include final hands or other outcomes that vary by player depending upon the different live game decisions made by the multiple players.

In various detailed embodiments, each of the multiple live players can be permitted to play the initial shared hand for multiple different plays with each different play resulting in a different final hand. The discarded physical items from the initial shared hand can include playing cards, and the discarded physical items can be replaced with similar replacement physical items to form a final hand or other final outcome.

In some detailed embodiments, the first live table game is draw poker. In such embodiments, provision of the first live table game may involve dealing five physical playing cards face up to form the initial shared hand and five additional physical playing cards face down to provide a first set of replacement cards for the cards in the initial shared hand. The dealing of all ten physical playing cards can takes place prior to any live game decisions made by the multiple live players. Each of the five face down cards can correspond to a specific face up card of the initial shared hand. Also, there can be exactly 31 possible final hands that can result from the initial shared hand in some embodiments.

In some embodiments, provision of the first live table game further involves dealing five more physical playing cards face down to provide a second set of replacement cards for the cards in the initial shared hand, where the dealing of all fifteen physical playing cards takes place prior to any live game decisions made by the multiple live players. In such instances, the first set of replacement cards is for a first play of the initial shared hand and the second set of replacement cards is for a second play of the initial shared hand that is separate from the first play. Each of the multiple live players can be permitted to play the first play, the second play, or both, and different wager amounts can be made on the first play and the second play. In various embodiments, provision of the first live table game further involves revealing all of the five additional face down physical playing cards after all of the live game decisions are made by the multiple live players. In some embodiments, the gaming table system can also be configured to provide advice based on commonly known strategies to the multiple live players regarding the play of the first live table game.

Further embodiments can involve only an electronic game table, or only a gaming terminal from the foregoing system, as well as any combination of the various features thereof.

In still further embodiments, various methods are disclosed for facilitating the play of a live wager-based draw poker game at a physical electronic gaming table using physical playing cards. Such methods can be performed, for example, at an electronic gaming table by a table controller or similar processor. Pertinent process steps can include accepting wagers on the live wager-based draw poker game from a first live player and a second live player, facilitating a deal of five physical playing cards face up to form an initial shared hand and five additional playing cards face down to provide a first set of replacement cards, wherein the initial shared hand is shared by the first live player and the second live player, detecting user inputs from the first live player and the second live player regarding live game decisions to discard one or more of the five physical playing cards in the initial shared hand, wherein the live game decisions of the first live player are different than the live game decisions of the second live player, preventing any further user inputs regarding decisions to discard, facilitating a reveal of the five physical playing cards in the set of replacement cards after the step of preventing, and determining a first outcome for the first player and a second outcome for the second player based on the different live game decision, the first outcome being different than the second outcome.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed electronic table game systems that provide for shared hands between players. These drawings in no way limit any changes in form and detail that may be made to the disclosure by one skilled in the art without departing from the spirit and scope of the disclosure.

DETAILED DESCRIPTION

Figure 1A:
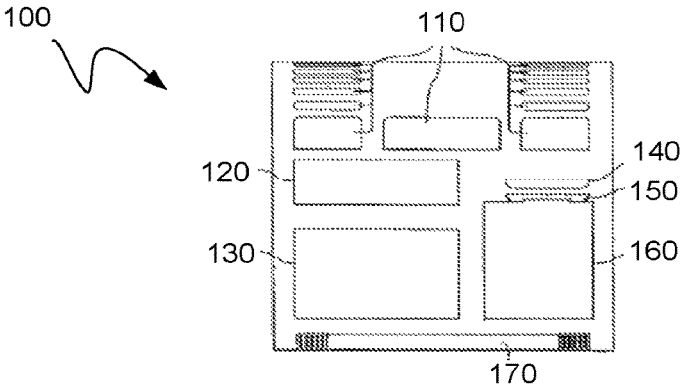
FIGS. 1A-1E illustrate in various views an exemplary gaming terminal adapted for the play of wager-based table games at physical electronic gaming tables according to various embodiments of the present disclosure.
Figure 1B:
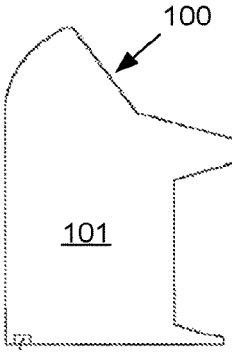
Figure 1C:
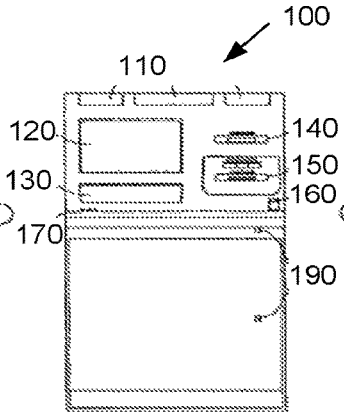
Figure 1D:
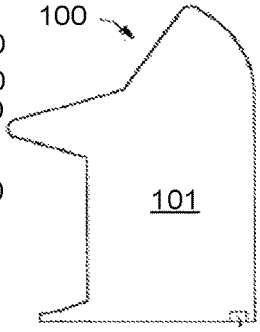
Figure 1E:
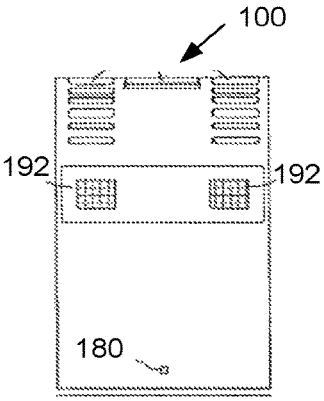

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure generally applies to devices, systems and methods for providing, conducting, and facilitating the play of live wager-based games at live physical electronic gaming tables that can include live dealers, live players, live gaming components, and electronic platforms. Although many detailed embodiments are provided with respect to draw poker, this disclosure may also be applied to any other live table game, such as other forms of poker, baccarat, blackjack, roulette, craps, pai gow, sic bo, bingo, keno, card games, and the like, as well as any other type of game having a live or electronic dealer, and/or one or more players seated at and/or remotely from a physical electronic gaming table or comparable terminal. In some embodiments, there may be no players seated at a physical electronic gaming table itself, such that all players are playing at gaming terminals that are located apart from or even remotely from the actual physical surface of the gaming table. The various embodiments disclosed herein can be applied with respect to individual gaming terminals or other associated gaming devices, individual physical electronic gaming tables or other similar devices, individual system servers that facilitate the use of such devices, entire systems having any combination of multiples for each of these components, and methods of running table games on such devices and systems.

The various embodiments provided herein may be applied in a gaming table system that monitors live wager-based table games in which physical or virtual cards are dealt to one or more players at, near, or associated with multiple gaming tables. Alternatively, or in addition, other physical gaming elements can be employed, such as dice, wheels, reels, cards, chips, tokens and the like. The game play data collected can be used to enable play of the same live table games remotely through gaming terminals. The gaming terminals may be any platform capable of receiving and transmitting data, including "thin-client" platforms or platforms which do not process game play data and "smart" platforms or platforms which process game play data. The gaming terminal may be stationary, similar to the slot machines or electronic tables commonly seen at the physical casino, or portable electronic devices such as smart phones, computer tablets, portable media players, laptop computers, desktop computers, smart TV, smart glasses, and the like. Additionally, the respective gaming network can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art. Thus, players interested in placing wagers on a live table games are not confined to the gaming table or casino floor.

In general, the present disclosure can pertain to one or more gaming terminals, one or more physical electronic gaming tables, and one or more electronic gaming system servers, among other system components. In various embodiments, a given gaming terminal, physical electronic gaming table and/or gaming table system allows remote player or gaming terminals to participate as if the remote player has a seat at the physical table. A relevant electronic gaming table system can include live electronic tables ("eTables"), remote game terminals (electronic gaming machine ("EGM"), smart phone, smart TV, tablet, desktop computer, etc.), a central games repository and a server that acquires the available live games from each eTable, indexes them and broadcasts the games and games history to other electronic tables, remote game terminals, and remote gaming sites, a multi-site games traffic server that receives remote game requests, verifies a player's eligibility (location, ID, funds, player profile, play history), enforces jurisdictional rules, and routes eligible bets to the player's requested game "channel" being broadcast, a financial server that acts as a Central Clearinghouse for remote wagers, and a network that connects the electronic tables, remote game terminals, the games repository and router, and the financial clearinghouse server.

A table processor and/or remote server can be used to administer the game, track player decisions and decide game outcomes for each player accordingly. Other components and items may also be present as desired. In addition to the various components, details and other aspects set forth herein with respect to the disclosed player terminals, gaming table systems and remote gaming in general, further details and explanations regarding such player terminals, electronic gaming tables and remote table game systems can be found at, for example, U.S. Pat. Nos. 7,914,368; 7,918,723; 7,922,587; 8,182,321; 8,210,920; 8,308,559; and 8,323,105, as well as U.S. patent application Ser. Nos. 13/948,101; 13/893,340; 13/844,617; 13/542,446; 13/456,110; 13/042,633; and 11/198,218, with these references being incorporated herein by reference in their entireties and for all purposes.

Various disclosed embodiments facilitate broader play of a single hand or other game play by numerous players at multiple electronic gaming tables across entire systems, so as to meet the challenges, interests, speeds, and/or flexibility desired by many game players and game providing establishments. This is accomplished at least in part through the use of gaming tables and gaming table systems that facilitate a live game play of the same shared hand by a virtually unlimited number of players. In particular, an initial shared hand that is shared by multiple live players can be played any number of ways by each player to result in a variety of possible final hands. In various embodiments, each of numerous multiple live players is permitted to make different live game decisions independently regarding discarding physical playing items from the initial shared hand, and the outcomes of the live game play include final hands that vary by player depending upon the different live game decisions made by the multiple live players.

Turning first to FIGS. 1A-1E, an exemplary gaming terminal adapted for the play of wager-based table games at physical electronic gaming tables is shown according to various embodiments of the present disclosure. FIG. 1A is a top plan view, while FIGS. 1B through 1E are side, front, side and back elevation views respectively. As noted herein, gaming terminal 100 can be referred to in a number of different ways, such as, for example, a gaming terminal, an electronic gaming machine ("EGM"), a player terminal, an electronic player terminal, and the like. Gaming terminal 100 can be linked to various different types of table games, and can be linked to multiple different tables, servers, and/or other system components, including simultaneously. A gaming terminal or player terminal can include any suitable EGM, and may include any platform capable of receiving and transmitting data, including "thin-client" platforms or platforms which do not process game play data and "smart" platforms or platforms which process game play data. A player terminal may be stationary, similar to the slot machines or electronic tables commonly seen at the physical casino, and/or may include various types of portable electronic devices such as smart phones, computer tablets, portable media players, laptop computers, desktop computers, smart TV, smart glasses, and the like.

Although a wide variety of possible layouts and arrangements can be applied to any given EGM or gaming terminal 100, a particular configuration is provided herein simply for purposes of illustration. As is generally shown in FIGS. 1A-1E, gaming terminal 100 can include an outer housing 101 that may include a processor or controller (not shown) located therein. Numerous input and output components can be located at various locations about gaming terminal 100. One or more lights or lamps 110 can indicate various status by way of lit, unlit and color arrangements. An upper screen 120 and lower screen 130 can provide various displays to a player, as well as touchscreens that accept player input. Alternatively, or in addition, one or more buttons may also be provided for player inputs. Other components can include a ticket printer 140, bill acceptor 150, shelf 160, and one or more speakers 170. Gaming terminal 100 may also include power input 180, a locking mechanism 190 and one or more fans 192 or other cooling components. Of course, many other input and output components may also be provided at gaming terminal 100, as will be readily appreciated. Further, other configurations, arrangements, shapes and sizes for the player terminal may also be used.

Figure 1F:
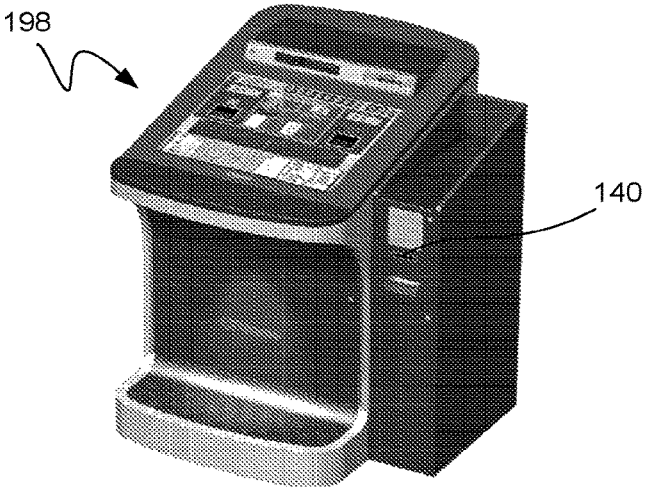
FIG. 1F illustrates in front perspective view an exemplary alternative gaming terminal adapted for the play of wager-based table games at physical electronic gaming tables according to various embodiments of the present disclosure.

FIG. 1F illustrates in front perspective view an exemplary alternative gaming terminal adapted for the play of wager-based table games at physical electronic gaming tables according to various embodiments of the present disclosure. Alternative gaming terminal 198 can be functionally identical or similar to gaming terminal 100, while differing in overall appearance, such as in size, shape, color, display location, button and input locations, and the like. Various identical or similar items may also be located on alternative gaming terminal 198, such as, for example, a ticket printer 140.

Figure 1G:
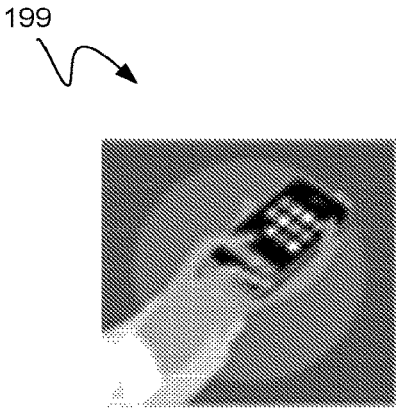
FIG. 1G illustrates in front perspective view still another exemplary alternative gaming terminal adapted for the play of wager-based table games at physical electronic gaming tables according to various embodiments of the present disclosure.

FIG. 1G illustrates in front perspective view still another exemplary alternative gaming terminal adapted for the play of wager-based table games at physical electronic gaming tables according to various embodiments of the present disclosure. Alternative gaming terminal 199 can be a smart phone or other portable user device that is configured to facilitate the play of live table games thereupon. Alternative gaming terminal 199 can also be functionally identical or similar to gaming terminal 100, although some abilities and features obviously may not be present, such as a ticket printer. In various embodiments, alternative gaming terminal 199 can be owned or controlled by an individual player, rather than a casino or other gaming establishment.

Figure 2A:
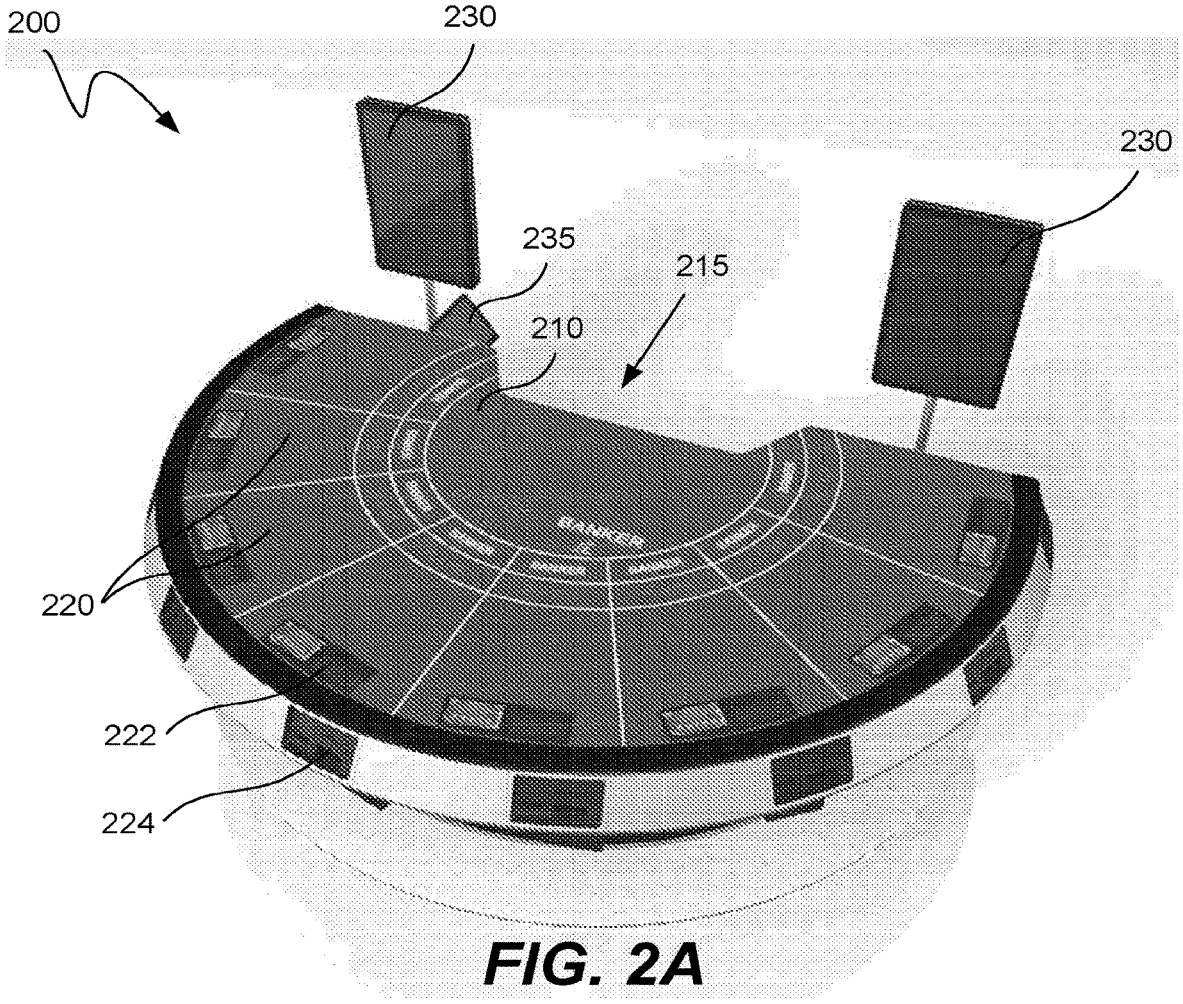
FIGS. 2A and 2B illustrate in top and front perspective views an exemplary physical electronic gaming table adapted for the play of wager-based table games according to various embodiments of the present disclosure.
Figure 2B:
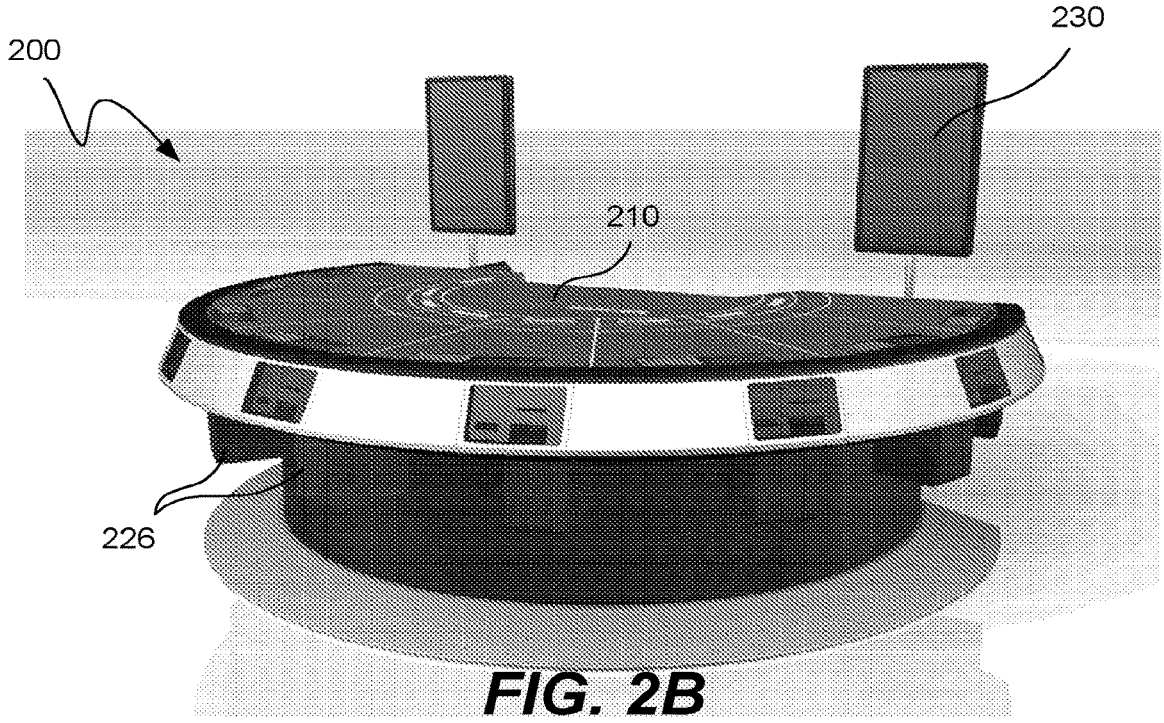

Referring next to FIGS. 2A and 2B, an exemplary physical electronic gaming table adapted for the play of wager-based table games according to various embodiments of the present disclosure is illustrated in top and front perspective views respectively. It will be readily appreciated that this physical electronic gaming table ("eTable") 200 can also be provided in numerous other configurations and formats, such that the provided example is for illustrative purposes only. The eTable 200 can include a playing surface 210 adapted for the play of live table games using live physical components, a live dealer station or region 215, a plurality of optional player stations 220, each of which may have its own displays 222, bill acceptor, card acceptor and other input components 224, and one or more community displays 230. One or more physical separators 226 may separate the different player stations 220. In some embodiments, eTable 200 might have no player stations, such that a live dealer merely plays or administers a live game at a table with no players, whereby all player action occurs at remote gaming terminals, such as one or more of electronic player terminal 100 above and/or one or more portable devices, as set forth in greater detail below.

Live dealer station or region 215 may include a dealer display and/or dealer inputs, such as by way of a dealer computing device 235, one or more ticket printers (not shown), one or more dedicated cameras (not shown), and/or various other items that aid a live dealer at the electronic gaming table 200. Dealer station or region 215 may also be referred to as a "dealer terminal" for purposes of an overall system, and can provide for a variety of specific live dealer related functions. For example, dealer terminal 215, such as by way of a dealer display, tablet, and/or other computing device 235, can provide for a dealer log in/out, information broadcasts, and/or manual overrides in case of errors, such as where an eShoe delivers too many cards or an automated hand resolution or payout is wrong. Each optional player position 220 around the eTable 200 can have a player terminal integrated into it. Like a standalone remote gaming terminal 100, each player terminal can have its own controller, buttons, touchscreen display, bill validator, printer, card reader, and so forth. The player terminals can be connected to a table controller ("TC") for the entire table via a switch/hub, and the TC connects to an overall local or wide area network, as provided in greater detail below.

Each eTable 200 can be hosted by a live human dealer, such as at a dealer station 215. The live human dealer can deal real cards and/or use real dice or other physical game components, which can be done on a wooden green-felt table surface 210, for example. Of course, other materials and/or colors may also be used. The cards can be drawn from an electronic shoe ("eShoe"), which is connected to the TC on the local table network. In some embodiments, the eShoe scans the cards and reads the rank and suits for each card removed. The TC, via player login data (such as player tracking card swipe or a cash insertion at the bill acceptor), knows which positions at the table are active and thus can monitor the progress of a game. One or more table sensors, such as a camera, RFID reader, or the like, can be used to capture video of the dealer action for broadcasting, as well as tracking of players and physical game components through a variety of means. Broadcasting can be made to the game server and other system servers, as well as to the various gaming terminals and system signage. The camera can also be used to further verify and keep a log of game activities, such as, for example, cards removed from the eShoe, cards dealt to player positions, bets entered, new players, and the like.

The eTable 200 can also have one or more displays. In one embodiment, there can be one or more community displays 230 to show common player information, such as community cards, table wager minimum, casino name, time, advertisement, and the like. Game history (e.g., baccarat roadmaps) may also be displayed on the same screen 230 or on a separate screen attached to or near the eTable 200. The eTable may also have discrete displays, such as On/Off/Flashing lights mounted underneath table graphics, to annunciate game information such as Banker Win, Player Win, New Game, No More Bets, and so forth. Such table screens and discrete displays can be driven by the TC.

Figure 3:
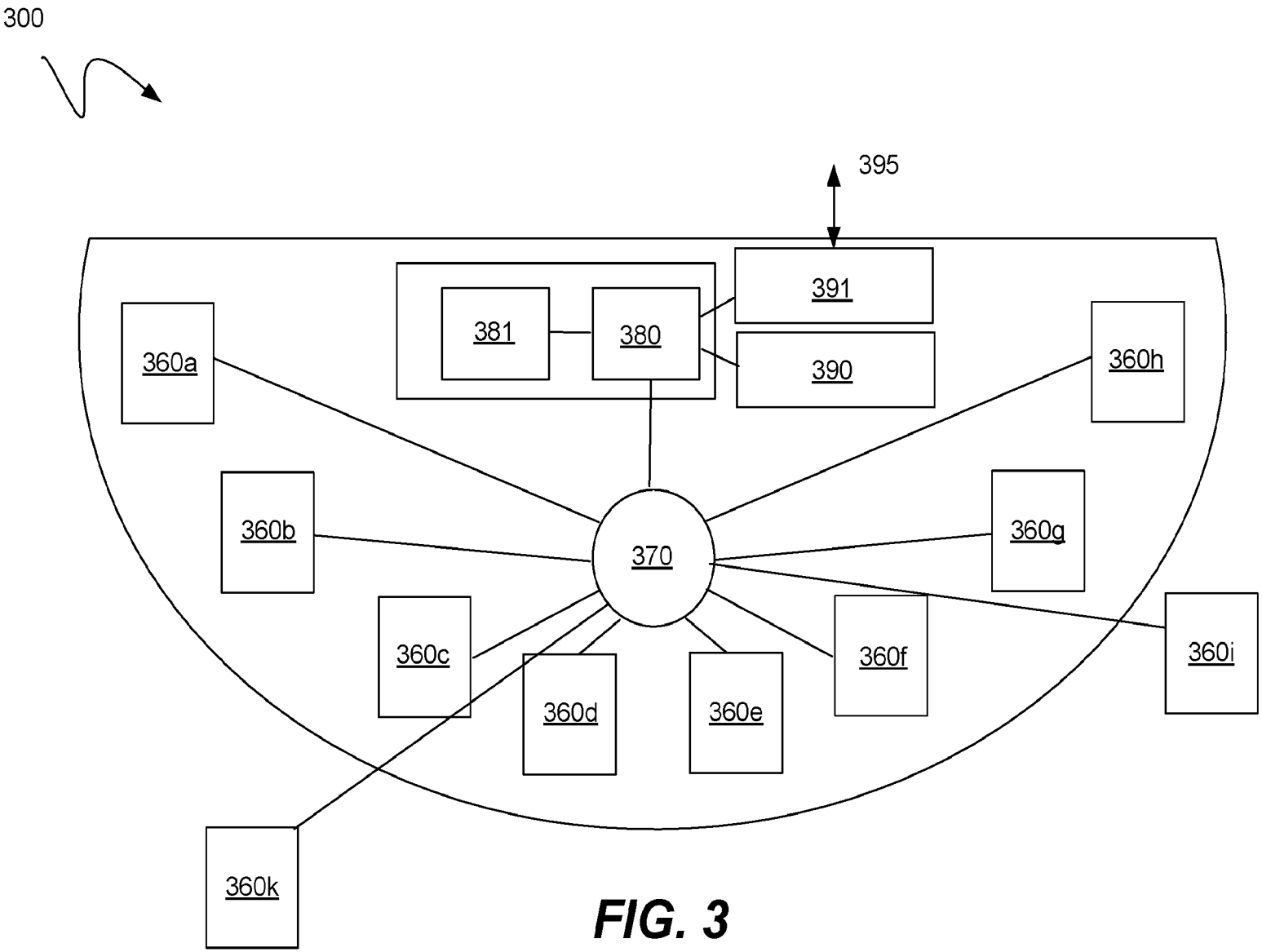
FIG. 3 illustrates in block diagram format an exemplary computing system for a physical electronic gaming table adapted for the play of wager-based table games according to various embodiments of the present disclosure.

Continuing with FIG. 3, an exemplary computing system for a physical electronic gaming table adapted for the play of wager-based table games is provided in block diagram format. In various embodiments, computing system 300 can be implemented on the physical electronic gaming table 200 set forth above. Computing system 300 for an eTable can include various individual processors and peripherals 360*a*-360*k* for a plurality of player terminals or stations. In various embodiments, each of these separate items can be an identical or substantially similar set of processors, displays, inputs and other components, as may be desirable for each separate player station. As shown, some of the player stations (e.g., 360*a* through 360*h*) may be physically present at the eTable, while other player stations or terminals (e.g., 360*i* and 360*k*) may be located away from the eTable. Such remotely located player stations or terminals can be nearby the table and within view of the playing surface and or an overhead display of the playing surface. In addition, one or more remotely located player stations or terminals can be located in a different room or different location entirely, such as where a video feed of the live table game can be provided to the player station for live play. Such remotely located player terminals can take the form of any of gaming terminals 100, 198, 199 above, and/or can be implemented on a third party user device, such as a smart phone, tablet, laptop, PDA, smart glasses, or the like, such as alternative gaming terminal 199.

All of the player station systems 360*a*-360*k* can couple to a central router or hub 370, which can be coupled to a master table controller ("TC") having a CPU 380 and memory or storage 381. As in the foregoing embodiment, a dealer station (not shown) may also be coupled to the TC, such that a live dealer may be able to provide input to the table as well. The TC can be coupled to one or more table displays 390, as well as a table communication interface 391 for outside communications with one or more other gaming table system components. Such other components can include, for example, gaming terminals, a remote game server, player tracking servers, financial servers, additional system servers, routers, databases and the like. Such table display(s) 390 can provide views of the playing surface to players that may be nearby the table but not in position to have a good view of the playing surface. In this manner, dozens or hundreds of players can be playing at a single table. Link 395 represents a connection to the network, so that system 300 is able to communicate with various other outside network or system components, such as a remote game server.

In various embodiments, a remote game server can administer some or all of the game away from the actual physical electronic gaming table. The remote server can have the rules of the game, and can be responsible to conduct the table game, such that the TC only conducts data acquisition. As such, the TC can be connected to the card shoe, shuffler, camera(s), dealer terminal, chip counter, overhead display(s), and so forth. In operation, the TC can collect raw data from these peripherals and then provide this data to the host game server located remotely. The remote host or game server can then provide any number of functions, such as, for example, to process the game according to game rules, store the game states, keep track of game history, resolve player hands, credit or debit player accounts, run the community display, and the like. Data from each player terminal can be collected by the table controller or processor (i.e., TC) and forwarded to the remote server, can be sent to the remote server directly from player terminals, or some combination thereof.

In various embodiments, there may or may not be live players at the eTable. That is, in some embodiments the eTable may not have any live players sitting at the table, and rather has only the dealer, playing surface, cards and/or other live physical game components. In such embodiments, all live players may wager on and participate in the game action through remotely located gaming terminals. Again, such remotely located gaming terminals may be nearby the eTable and within view of the playing surface and/or one or more community displays. For example, such nearby player terminals can be within 100 feet of the eTable. Of course, further distances and/or removed locations to other rooms or properties are also possible, such as where the remotely located players can view a video of the live game action.

Figure 4:
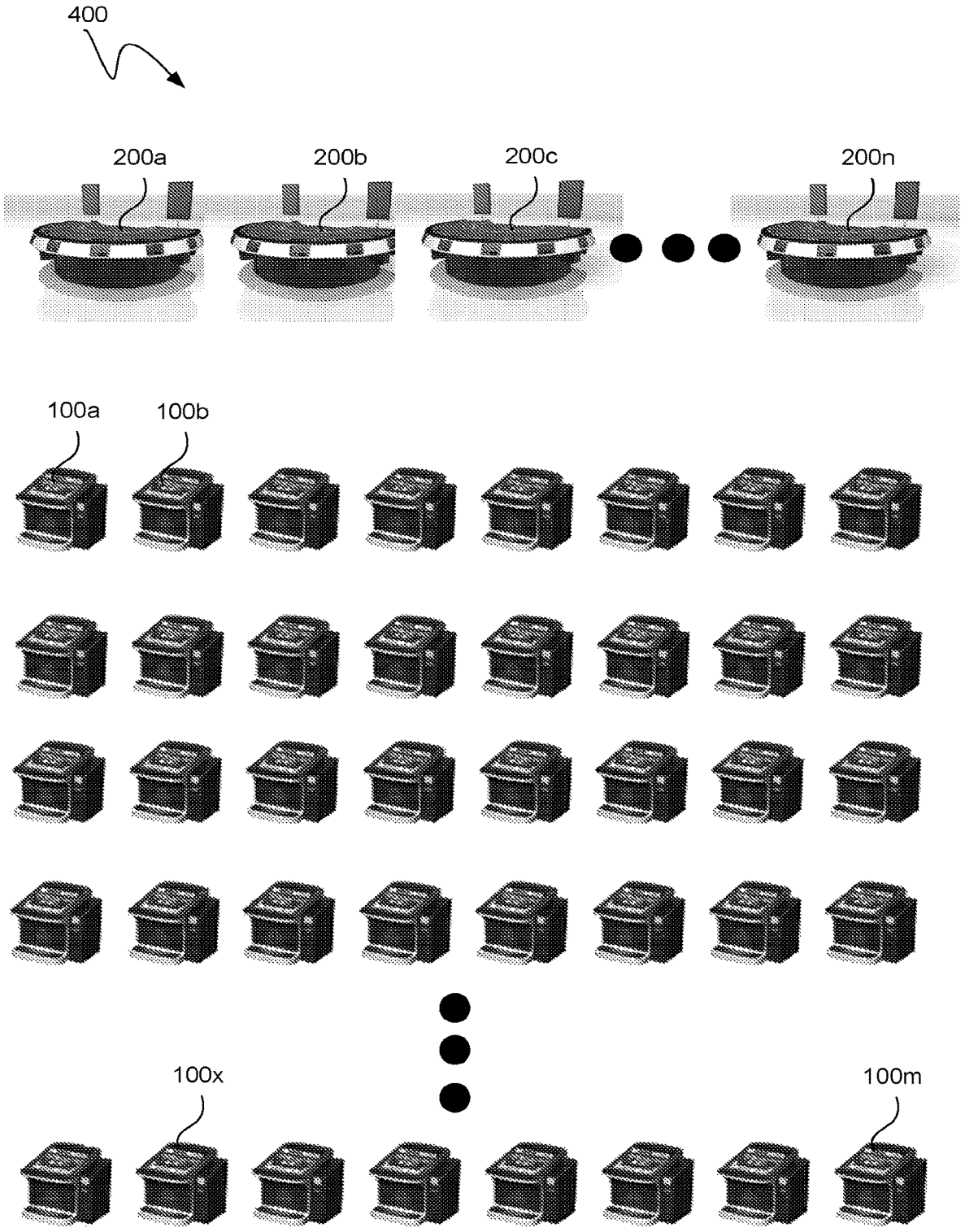
FIG. 4 illustrates in block diagram format an exemplary gaming table system having multiple gaming terminals and multiple physical electronic gaming tables according to various embodiments of the present disclosure.

Moving now to FIG. 4, a block diagram is provided for an exemplary gaming table system having multiple gaming terminals and multiple physical electronic gaming tables according to various embodiments of the present disclosure. Localized gaming table system 400 can include a plurality of eTables 200*a*-200*n*, as well as numerous gaming terminals 100*a*-100*m* arranged in the vicinity of and in view of the eTables. As one example, each of about 40 gaming terminals 100*a*-100*m* can be in communication with each of about 4 eTables 200*a*-200*n*. While about 4 physical electronic gaming tables and about 40 gaming terminals are shown, it will be understood that more or fewer gaming tables and more or fewer gaming terminals may be provided in a given gaming table system set forth on one or more given casino floors and/or other locations. For example, a gaming table system might have 10 or more physical electronic gaming tables in some arrangements.

In various embodiments, a player at a given gaming terminal 100*x* may be provided the ability, such as by way of a button or other input, to switch between any combination of different physical electronic gaming tables 200*a*-200*n*. Further, the player at the given gaming terminal 100*x* may also be allowed to play multiple wager-based table games simultaneously at multiple different physical electronic gaming tables 200*a*-200*n*. For example, the player may be permitted to play table games at one, some, many, or all of the gaming tables 200*a*-200*n*, depending upon the choices of the player. Where the player is a fast player that likes to play lots of different table games at once, the player might choose to play games at all of the different physical electronic gaming tables 200*a*-200*n* simultaneously. Alternatively, the player may decide to play games at only one or two of the various system gaming tables. One, some, or all of the gaming terminal 100*a*-100*m* may be configured to allow for a given player thereat to choose the exact number of games desired to play simultaneously.

Figure 5:
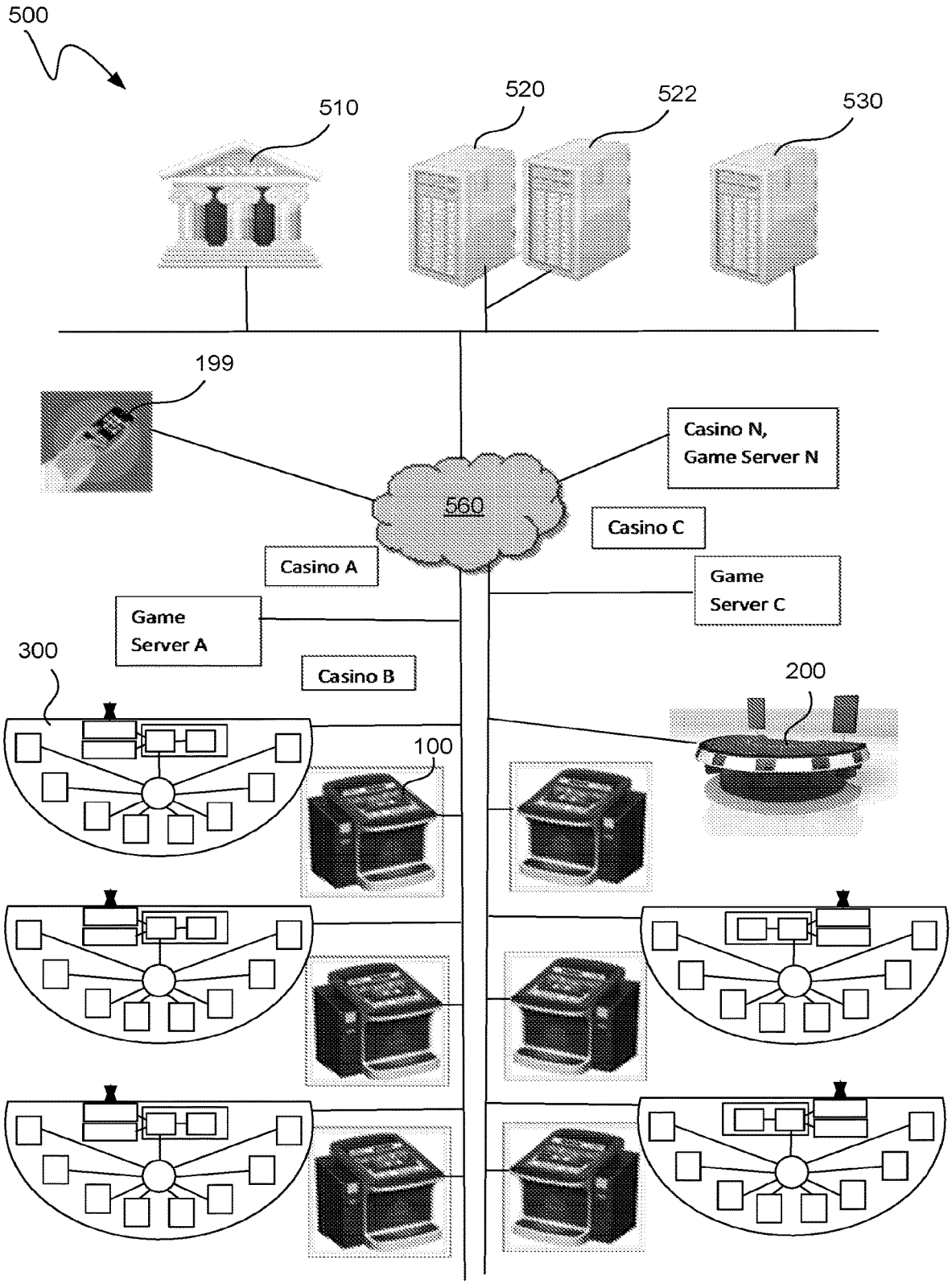
FIG. 5 illustrates in block diagram format an exemplary gaming table system having multiple gaming terminals, multiple physical electronic gaming tables, and multiple system servers across multiple locations according to various embodiments of the present disclosure.

FIG. 5 illustrates in block diagram format an exemplary gaming table system having multiple gaming terminals, multiple physical electronic gaming tables, and multiple system servers across multiple locations according to various embodiments of the present disclosure. Gaming table system 500 can be a wide area system that includes a variety of components and items, such as a bank 510, one or more system servers 520, 522, and a financial clearinghouse 530, among other possible components and items. A cloud 560 or network can couple these items to various eTables, gaming terminals, game servers, casinos, and other distributed components. One or more personal devices 199 can serve as remote player terminals in some embodiments, as noted above. Various networked casinos, game servers, eTables 200, 300, and other remote terminals 100 can also be coupled through the cloud 560 or network in gaming table system 500. As will be readily appreciated, some or all of the remote terminals in gaming table system 500 can take the form of player terminal 100 set forth above, as well as any suitable variation thereof.

One or more system servers 520, 522 and game servers may be present in gaming table system 500, and each can operate in a particular manner to facilitate the play of the various table games set forth above. In such embodiments, a given game server can collect live game information from each eTable, apply game rules, and return game results. Beside monitoring and controlling the games, a game server can also keep track, in a database, of game history of each eTable, accounting information, revenue reports, maintenance information, and the like. Each of these individual functions can be performed by a separate application on a separate server, or integrated into one application running on one comprehensive server. The determination of one or multiple servers and applications depends on the number of eTables, game stations, and/or remote gaming terminals, both local and remote, that are being connected across the system.

Each separate casino or gaming establishment can have a singular or multiple game servers, and each game server can be configured to serve a particular game type (e.g., baccarat, blackjack, roulette, craps, and the like), a quantity of tables, gaming terminals or game stations, or an area of the casino. In a multi-game, multi-site environment, one important function of the game server is the handling of financial transactions from remote game terminals. In some situations, remote game terminals can be logged into a particular eTable. From there, the remote player either participates directly as if he or she is sitting at the table, or back bets on one of the players at the table. In gaming table system 500, however, a remote player need not be constrained to any particular physical eTable. For instance, a player sitting at a seat on a local eTable can wager on the game on going at the local table and at another table at the same casino, or at an eTable at a casino located elsewhere. These capabilities are enabled by a network of game servers, one or more system servers 520, 522, and a central financial clearinghouse 530 for remote wagers. Further details regarding a wide area electronic gaming table system utilizing multiple system components across multiple locations can be found at for example, U.S. Pat. Nos. 7,914,368; 7,918,723; 7,922,587; 8,182,321; 8,210,920; 8,308,559; and 8,323,105, as well as U.S. patent application Ser. Nos. 13/948,101; 13/893,340; 13/844,617; 13/542,446; 13/456,110; 13/042,633; and 11/198,218, with these references again being incorporated herein by reference in their entireties and for all purposes.

Gaming table system 500 may also be configured to allow live game play of the same shared hand by a virtually unlimited number of players across the system. Again, an initial shared hand that is shared by multiple live players can be played any number of ways by each player to result in a variety of possible final hands. For example, each player can be permitted to make different live game decisions independently regarding discarding physical playing items from the initial shared hand, and the outcomes of the live game play include final hands that vary by player depending upon the different live game decisions made by the multiple live players.

Figure 6:
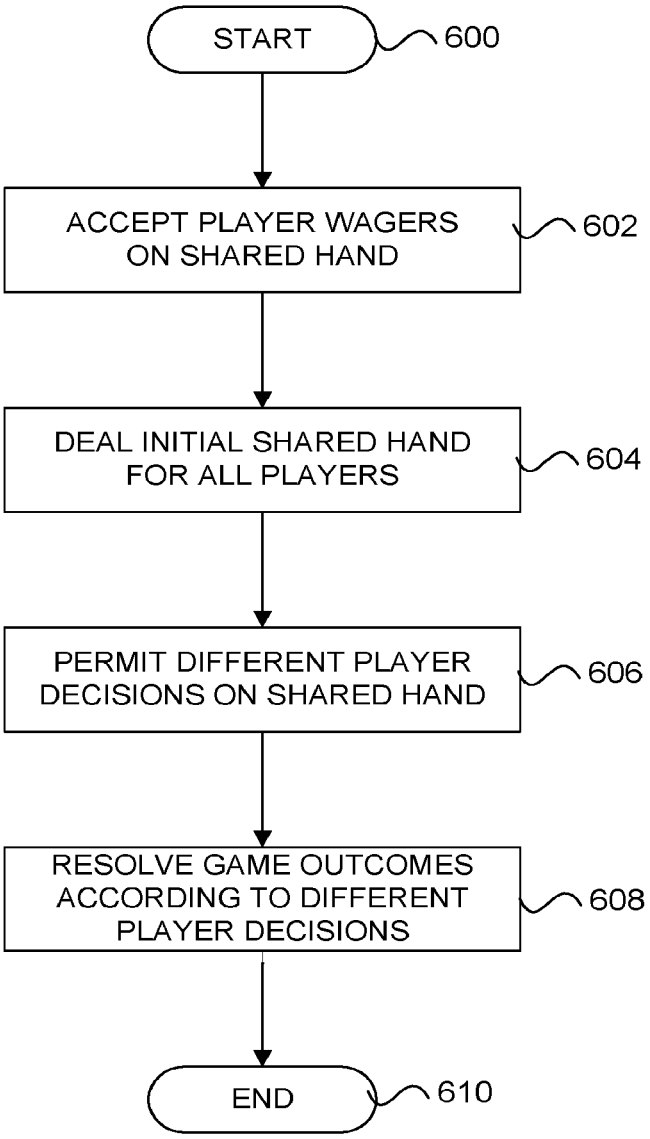
FIG. 6 illustrates a flowchart of an exemplary method of providing a live wager-based game having a shared hand at a physical electronic gaming table according to various embodiments of the present disclosure.

Turning next to FIG. 6, a flowchart is provided of an exemplary method of providing a live wager-based game having a shared hand at a high level. After a start step 600, player wagers on a shared hand or other form of live gaming play can be accepted at process step 602. At a following process step 604, an initial shared hand (or play) can be dealt, with the initial shared hand belonging to all players. At the next process step 606, different player decisions on how to play the initial shared hand can be permitted. At subsequent process step 608, game outcomes can be resolved according to the different player decisions, with the game outcomes varying due to the different player decisions. The method then ends at an end step 610.

As will be readily appreciated, this method can allow for dozens or hundreds of players to play the same hand or other gaming play of a wager-based table game, but have different outcomes based upon the way that each player decides to play the hand or game play. This can apply to many different table games depending upon how the play of physical items on the gaming table is provided. For example, a single hand of draw poker can be played numerous ways depending upon which cards are to be held or discarded. Further details are provided below regarding various possible physical implementation of how such a single hand can allow all possible decisions by many players for a single shared hand.

Figure 7:
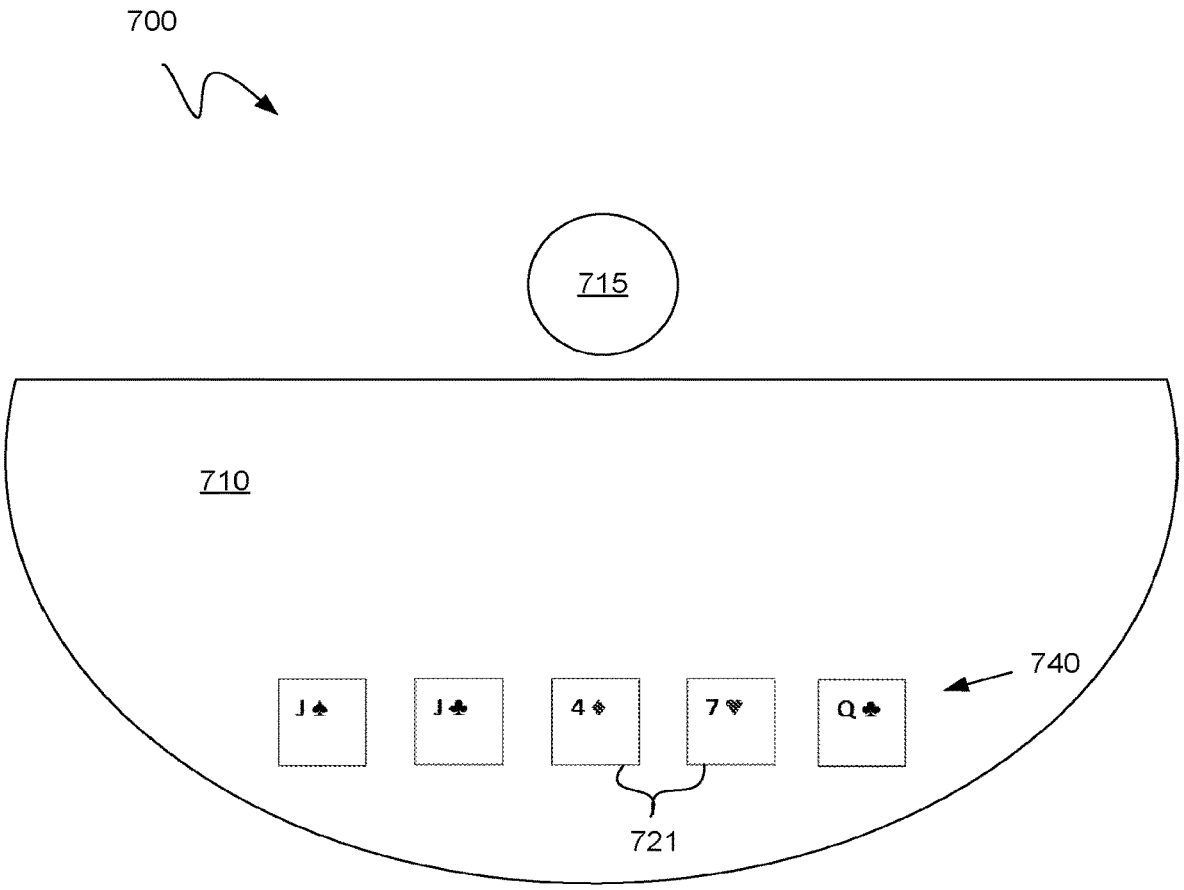
FIG. 7 illustrates a representation of an exemplary initial shared hand at a physical electronic gaming table according to various embodiments of the present disclosure.

Moving now to FIG. 7, a representation of an exemplary initial shared hand at a physical electronic gaming table is provided. Configuration 700 includes a physical electronic gaming table having a physical surface 710 adapted for the play of wager-based games, as well as a live dealer 715 that administers the games. Again, a game of draw poker is provided for purposes of illustration, but it will be understood that a wide variety of other forms of poker, other card games, and other wager-based games may alternatively be provided. Wagers can be placed by multiple live players prior to the play of the game, after which an initial shared hand 740 is dealt by the live dealer. The initial shared hand 740 can have five physical playing cards that are dealt face up 721 so as to be visible to everyone. Although the depicted initial shared hand 740 is JJ47Q, it will be readily appreciated that any other combination of dealt cards will similarly constitute the initial shared hand for the game.

Figure 8A:
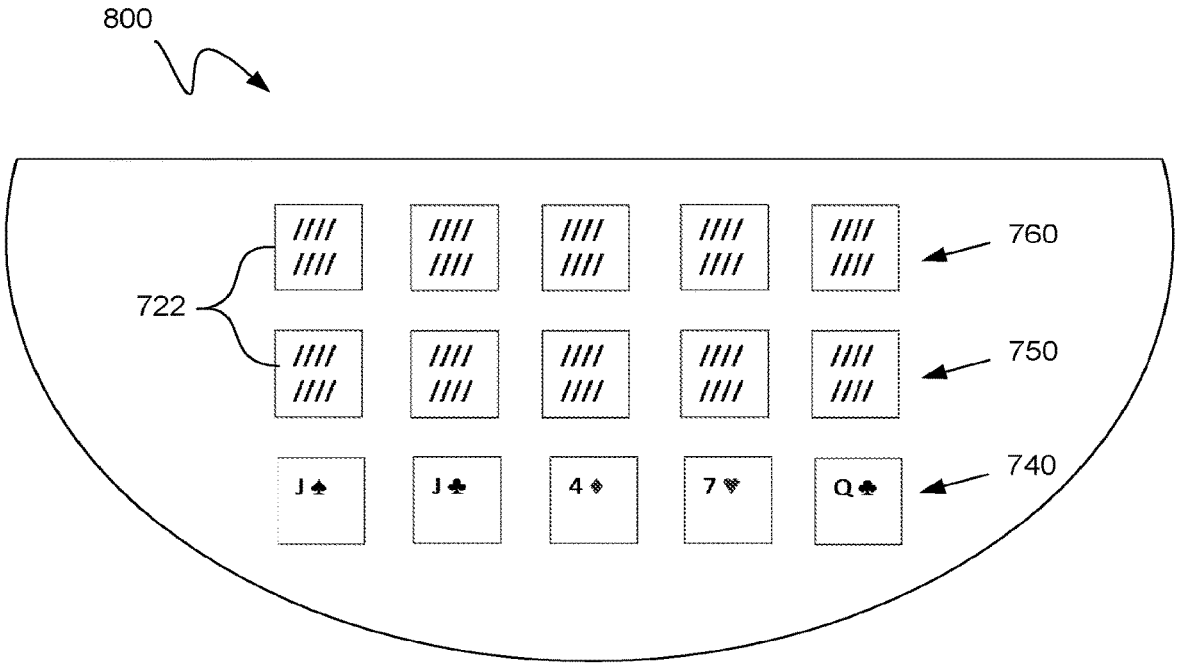
FIG. 8A illustrates a representation of the initial shared hand of FIG. 7 and two exemplary sets of replacement cards dealt face down according to various embodiments of the present disclosure.

FIG. 8A illustrates a representation of the initial shared hand of FIG. 7 and two exemplary sets of replacement cards dealt face down according to various embodiments of the present disclosure. Configuration 800 includes the physical electronic gaming table and the initial shared hand 740. In addition, a first set of replacement cards 750 and a second set of replacement cards 760 have now also been dealt. Each set of replacement cards 750, 760 has five cards that are dealt face down 722 so that nobody yet knows which cards they are. Each set of replacement cards 750, 760 contains one replacement card corresponding to each card dealt face up in initial shared hand 740, and the cards can be arranged in an array as shown so that it is clear which replacement card would replace each card in the initial shared hand.

Although two sets of replacement cards 750, 760 are shown, it will be understood that only one set of replacement cards may be dealt, or alternatively that more than two sets of replacement cards may be dealt, such as where more than two separate opportunities to play the initial shared hand 740 are provided to players. For example, three, four, or even more sets of replacement cards can be dealt to provide even more plays for a single players from the same initial shared hand. In general, the number of rows of 5 cards to be dealt can be N+1, where N is the number of hands or plays possible from the same initial shared hand for one player. In some embodiments, a player can choose which row or rows of cards (i.e., set(s) of replacement cards) from multiple rows available that the player wishes to wager on and play. In some embodiments, the number of sets of replacement cards (i.e., the number of possible separate plays of the same initial shared hand) can depend upon the wager size of the player. Where a player wagers more, then more sets of replacement cards may be available to the player.

Each set of replacement cards provides a possible game play for a participating live game player with respect to the initial shared hand 740. That is, a live game player may choose to play the draw poker game once starting with initial shared hand 740, and then using the first set of replacement cards 750 to play the game, or using the second set of replacement cards 760 to play the game. Alternatively, the live game player may choose to play the draw poker game twice using both sets of replacement cards 750, 760 for two separate plays of the game. Each set of replacement cards 750, 760 provides a separate game play that is evaluated independently. Preferably, wagers on each play of the game are placed prior to the deal of any cards for the game. That is, a wager may be placed on the play using the first set of replacement cards 750 and/or the play using the second set of replacement cards 760. As one example, a live player may choose which sets of replacement cards to play by placing a wager on the appropriate row for that set of cards before the hand is dealt. Again, more than two separate plays may be provided by dealing more sets of replacement cards for such plays. In various embodiments, each set of replacement cards are physical playing cards dealt from the same single deck from which the initial shared hand 740 was dealt. Further, the entire array of face up initial shared hand 740 and face down sets of replacement cards 750, 760 may all be dealt at the same time by the live dealer administering the game.

With wagers placed and cards dealt for the full game, each of the multiple live players is permitted to make different live game decisions independently regarding discarding (or holding) physical playing cards from the initial shared hand. That is, each live player may choose to discard or hold each card in the initial shared hand 740 regardless of whatever every other live player chooses to do. For each card discarded from initial shared hand 740, the corresponding replacement card from the first set of replacement cards 750 is used to replace that discarded card. While some players may choose to discard all cards, some may choose to discard one or two cards, others may choose to discard one or two different cards, and still others may choose to discard no cards.

The outcomes of the live table game then include final hands that vary by player depending upon the different live game decisions made by the multiple live players. In the particular example using the first set of replacement cards 750, each final hand includes the cards from the initial shared hand 740 that were held along with the corresponding replacement cards from the first set of replacement cards 750 for the cards from the initial shared hand that were discarded. Because any difference in game decisions regarding which cards to hold and which cards to discard results in different cards being replaced, each live game decision that is different results in a different final hand or outcome. In some embodiments where a player is playing both the first and second sets of replacement cards 750, 760, the player decisions on which cards to hold and which cards to discard can be the same for both plays, or can alternatively be different for each separate play. After all live game decisions are made by all live players regarding which cards to hold and which cards to discard from the initial shared hand 740 for each separate play, the replacement cards are then all turned face up. In some embodiments, a set amount of time is provided for players to input their choices, after which no further inputs are accepted.

Figure 8B:
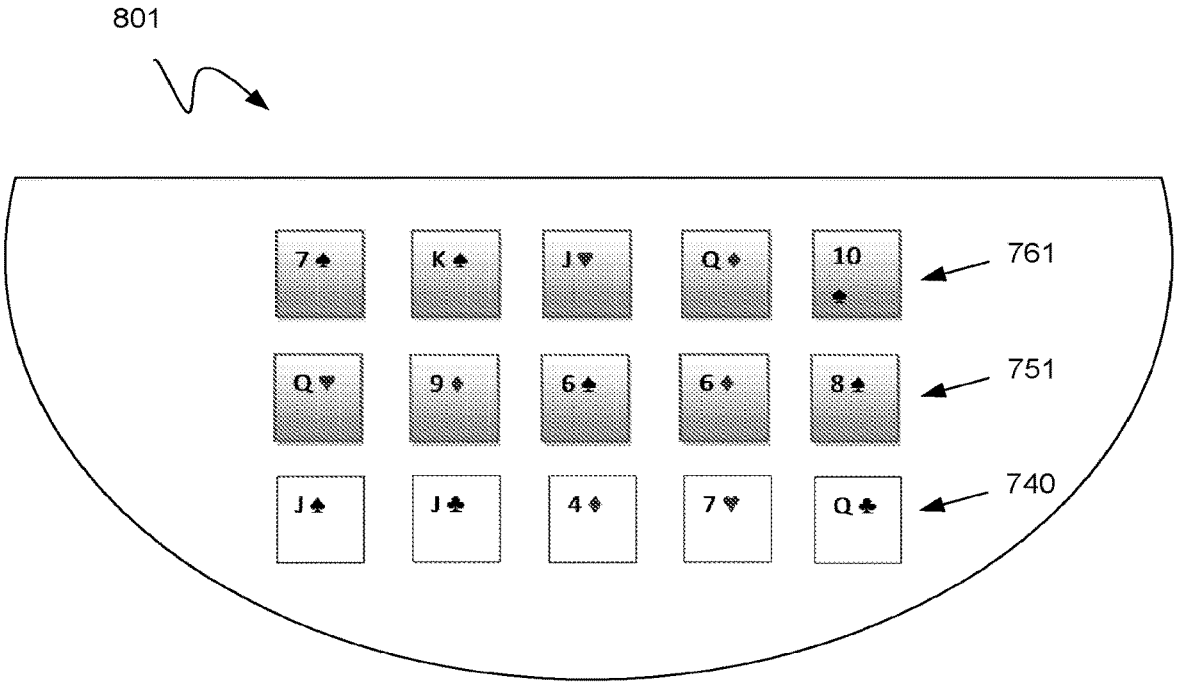
FIG. 8B illustrates a representation of the initial shared hand and two sets of replacement cards of FIG. 8A with the replacement cards turned face up according to various embodiments of the present disclosure.

FIG. 8B illustrates a representation of the initial shared hand and two sets of replacement cards of FIG. 8A with the replacement cards turned face up. Configuration 801 again includes the physical electronic gaming table and the initial shared hand 740. Further, the first set of replacement cards 751 is turned face up and the second set of replacement cards 761 is also turned face up. With the identities of each replacement card in each set of replacement cards being revealed, the gaming system can then apply the appropriate replacement cards as selected for each play made by all of the live players to form an appropriate final hand for each play. Where a player did not choose to discard a given card from the initial shared hand 740 for a game play, then the corresponding replacement card is turned face up but can just be ignored. The player may see what the card was had the choice been made to discard, but the original card from the initial shared hand 740 plays to the final hand for the player if that card was held.

It will be appreciated that FIGS. 7-8B show what takes place on the physical electronic gaming table itself. In various embodiments, a video feed, still picture, and/or other live representation of the actual physical playing cards at the physical electronic gaming table can be provided to players on their respective gaming terminals during play of the live table game. Players can thus see the actual face up cards of the initial shared hand, the actual face down replacement cards, and the subsequent actual face up replacement cards after game play is finished. Players are then able to determine how they fared with respect to the deal of the physical cards, and how it might have been possible to fare if other hold and discard choices had been made for each of the possible game plays.

In addition to the video feed, still picture, and/or other live representation of the actual physical playing cards, gaming terminals can also provide a graphical representation of the cards on the gaming table. This graphical representation can be altered to more readily present to players what is happening with respect to their specific play of the wager-based games. Further illustrations are now provided to give examples of how particular game plays might look for different players using the same initial shared hand 740 on the graphical representations. Again, these displays can be in addition to an actual live video or still picture feed.

Figure 9A:
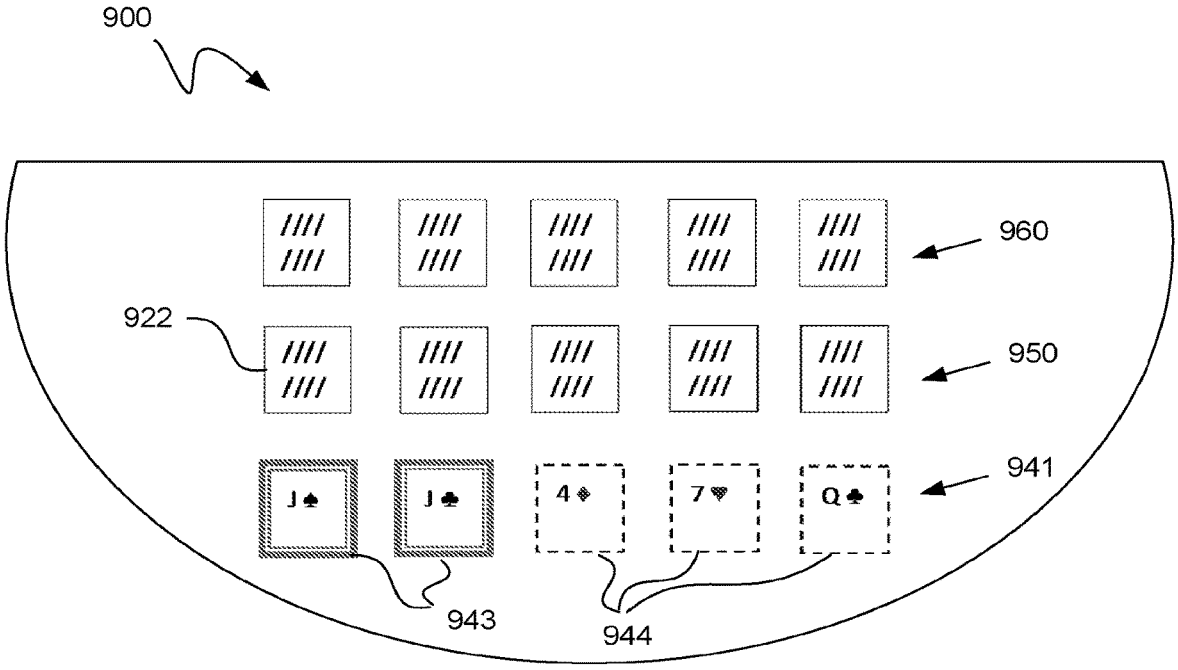
FIG. 9A illustrates a graphical representation of a player live game decision for the initial shared hand and two sets of replacement cards of FIG. 8A according to various embodiments of the present disclosure.

FIG. 9A illustrates a graphical representation of a player live game decision for the initial shared hand and two sets of replacement cards of FIG. 8A according to various embodiments of the present disclosure. Configuration 900 can be a live feed or a graphical reconstruction at the gaming terminal of a first live player. In playing the initial shared hand, the first live player now has a played hand 941 that includes a live game decision for held cards 943 and discarded cards 944. As shown, the held cards include the JJ, while the discarded cards include the 47Q. At this point, the player choices are input for played hand 941, while a first set of replacement cards 950 and a second set of replacement cards 960 are shown as still having all face down cards 922. For purposes of illustration, the first player is playing both of the first and second sets of replacement cards 950, 960, and has made the same hold and discard choices for each of these separate game plays.

Figure 9B:
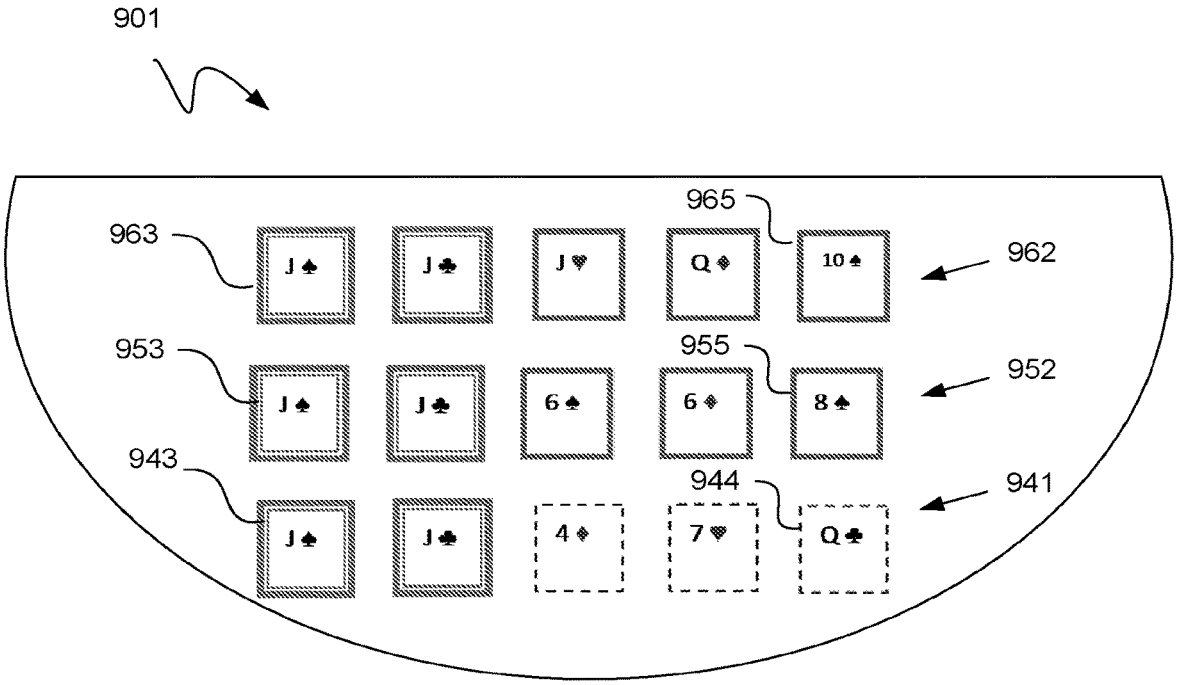
FIG. 9B illustrates a graphical representation of the outcome of the player live game decision of FIG. 9A according to various embodiments of the present disclosure.

FIG. 9B illustrates a graphical representation of the outcome of the player live game decision of FIG. 9A. Configuration 901 shows final hands 952 and 962 that are the result of the live game decisions made by the first live player at configuration 900. The held cards 943 of JJ are replicated as final cards 953 for final hand 952 and final cards 963 for final hand 962. The actual replacement cards from the first and second sets of replacement cards 950, 960 may or may not be shown to the player, but the held cards 943 are part of each final hand 952, 962 regardless of whether these replacement cards are shown. Conversely, the discarded cards 944 of 47Q are not replicated to the final hands 952, 962. Rather, the corresponding replacement cards 955 from the first set of replacement cards 950 are used to form the final hand 952, while the corresponding replacement cards 965 from the second set of replacement cards 960 are used to form the final hand 962. As can be seen, these replacement cards 955, 965 reflect that which is shown in the final reveal of FIG. 8B. In addition to displaying the final hands 952, 962 to the first player as a result of the specific live game decisions made by the first player, the system may also alert the first live player to what the final hands are, those being two pair and three of a kind in this example. Depending upon the particular game and paytables, these outcomes may result in a win or monetary award for the first live player. Other live players may have fared better or worse depending upon the live game decisions made by the other live players.

Figure 10A:
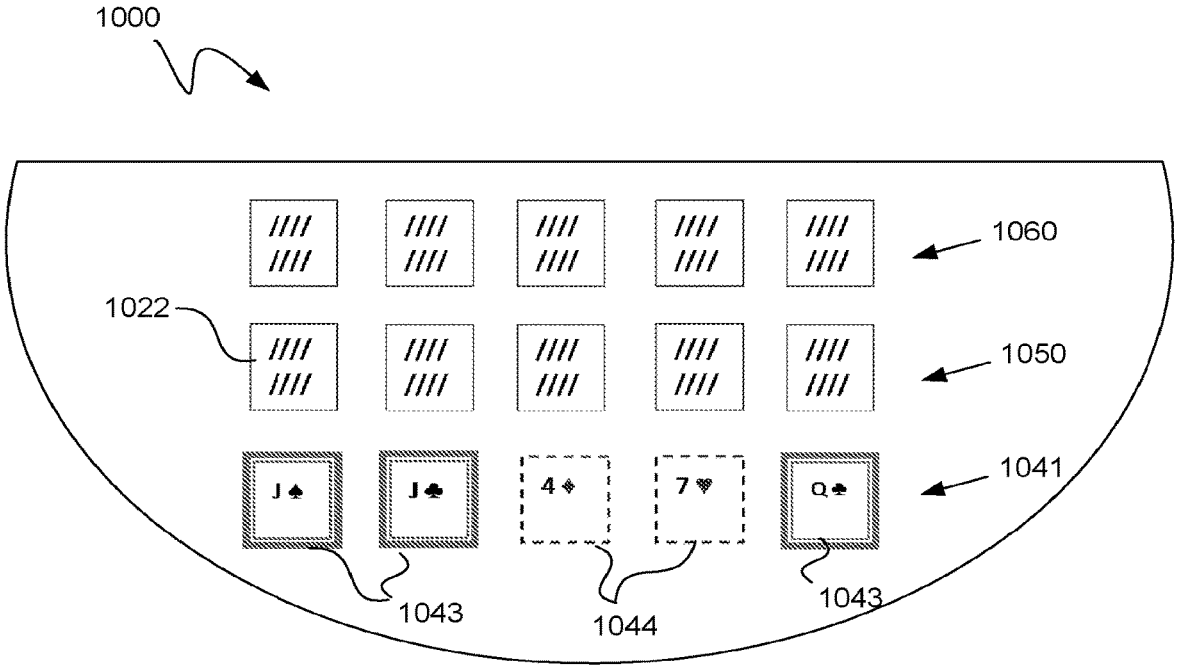
FIG. 10A illustrates a graphical representation of an alternative player live game decision for the initial shared hand and two sets of replacement cards of FIG. 8A according to various embodiments of the present disclosure.

As another example of how this particular play of draw poker might work for different live game decisions made by another live player, FIG. 10A illustrates a graphical representation of an alternative player live game decision for the initial shared hand and two sets of replacement cards of FIG. 8A. Configuration 1000 is similar to configuration 900 above, and can be a live feed or a graphical reconstruction at the gaming terminal of a second live player. In playing the initial shared hand, the second live player now has a played hand 1041 that includes a live game decision for held cards 1043 and discarded cards 1044. As shown, the held cards include the JJQ, while the discarded cards include the 47. At this point, the player choices are input for played hand 1041, while a first set of replacement cards 1050 and a second set of replacement cards 1060 are shown as still having all face down cards 1022. As may be appreciated, these can effectively be the same as sets 950, 960, and cards 922 shown above.

Figure 10B:
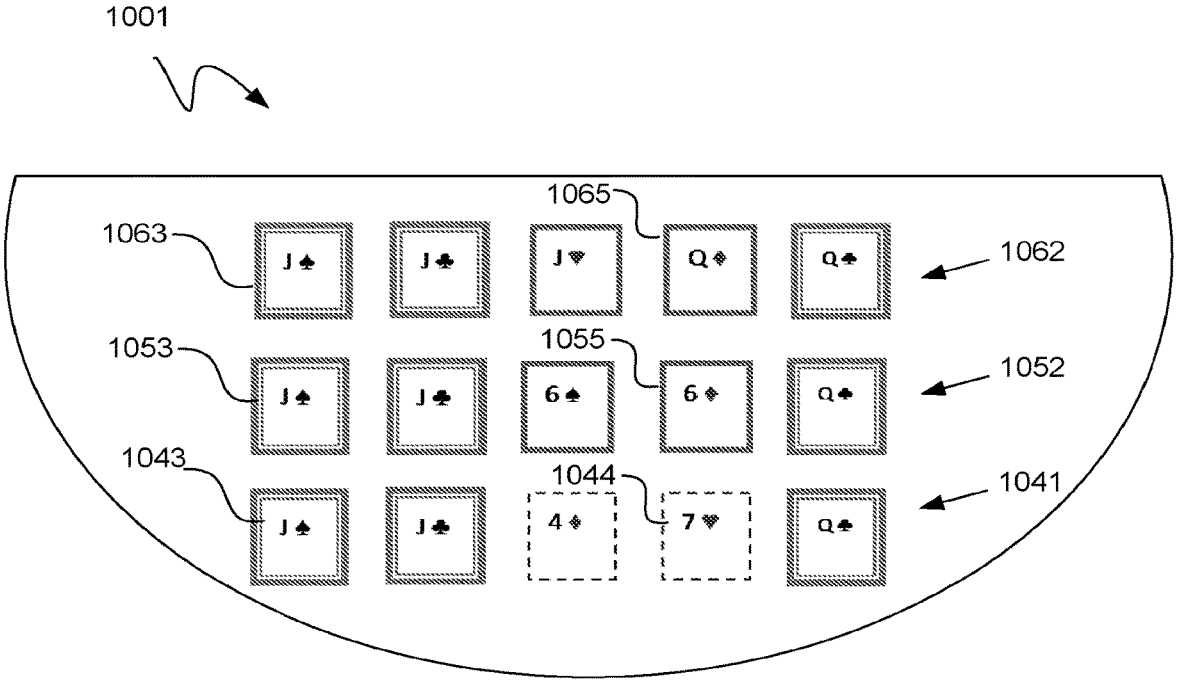
FIG. 10B illustrates a graphical representation of the outcome of the player live game decision of FIG. 10A according to various embodiments of the present disclosure.

FIG. 10B then illustrates a graphical representation of the outcome of the player live game decision of FIG. 10A. Configuration 1001 shows final hands 1052 and 1062 that are the result of the live game decisions made by the second live player at configuration 1000. The held cards 1043 of JJQ are replicated as final cards 1053 for final hand 1052 and final cards 1063 for final hand 1062. Again, the actual replacement cards from the first and second sets of replacement cards 1050, 1060 may or may not be shown to the player. Conversely, the discarded cards 1044 of 47 are not replicated to the final hands 1052, 1062. Rather, the corresponding replacement cards 1055 from the first set of replacement cards 1050 are used to form the final hand 1052, while the corresponding replacement cards 1065 from the second set of replacement cards 1060 are used to form the final hand 1062. As can be seen, these replacement cards 1055, 1065 also reflect that which is shown in the final reveal of FIG. 8B. Again, the system may also alert the second live player to what the final hands are, those being two pair and a full house in this particular example. Similarly, these outcomes may result in a win or monetary award for the second live player.

Of course, any combination of cards may be held or discarded in a typical hand of draw poker, such that there are numerous possible different live player decisions and inputs based only on which cards are held and discarded. For a typical hand of draw poker, there are 31 possible different ways to hold and discard cards from the starting hand. Thus, there are 31 possible player decisions for each play of a given initial shared hand in these examples. Each live player may choose his or her own way to play, and the outcomes are provided according to the different live decisions of each separate player.

In some embodiments, it may be possible for a live player to adjust his or her wager after seeing some of the dealt cards. For example, a player may be allowed to add to his or her wager upon seeing the initial shared hand, depending upon the policies of the gaming provider. In some embodiments, players may participate in a table game tournament using the game play of a shared initial hand. Such table game tournaments may allow players to compete for the best scores regarding quantity of games played, periods of time played, bank roll, locations, game types, or some combination thereof.

In some embodiments, the provided gaming table system can be configured to provide advice to the multiple live players. Such advise can be based on commonly known strategies to the play of the subject game. For example, the system may provide advice or hints regarding how a given five card draw poker hand is typically played by experts or good players. As a more specific example, for the initial shared hand of JJ47Q shown above, the system might provide advice to the player at some portion of the display screen that experts or most players would hold the JJ and discard the other cards for that particular starting hand. Other advice or hints may similarly be provided for different hands or different games.

Figure 11:
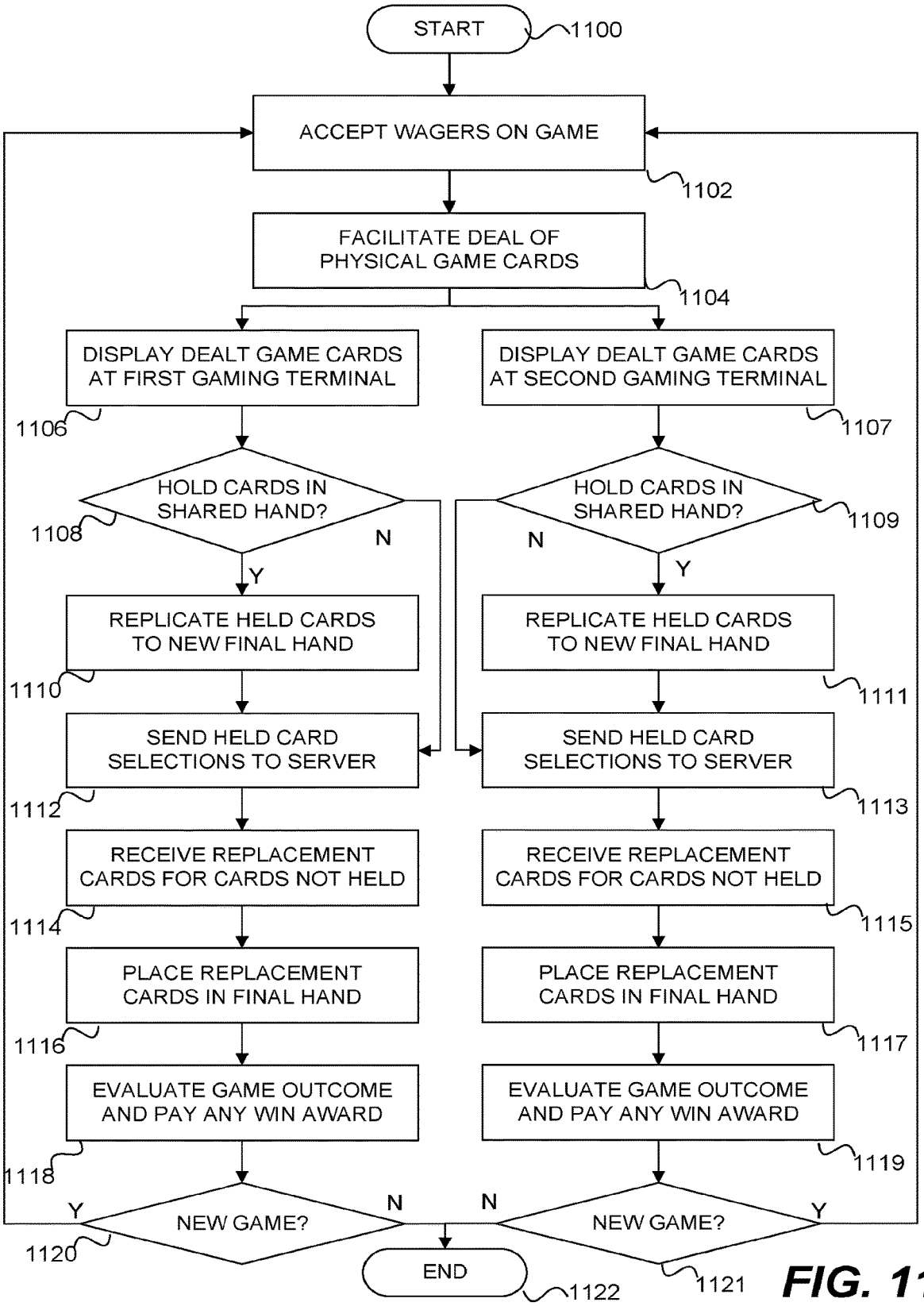
FIG. 11 illustrates a flowchart of an exemplary method of providing a live wager-based draw poker game at multiple gaming terminals according to various embodiments of the present disclosure.

FIG. 11 illustrates a flowchart of an exemplary method of providing a live wager-based draw poker game at multiple gaming terminals according to various embodiments of the present disclosure. After a start step 1100, wagers on a given game play are accepted at a process step 1102. The deal of physical game cards is then facilitated at process step 1104. The next process steps can then occur simultaneously at separate gaming terminals. At process step 1106, the dealt game cards are displayed at a first gaming terminal, while at process step 1107 the dealt game cards are displayed at a second gaming terminal that is separate from the first gaming terminal. Although not shown, further similar process step streams can also run in parallel for each separate gaming terminal. That is, the shown process steps for the first and second gaming terminals can similarly be provided at a third gaming terminal, a fourth gaming terminal, and so forth.

After process steps 1106 at the first gaming terminal and 1107 at the second gaming terminal, inquiries are made at decision steps 1108 and 1109 at both of the first and second gaming terminals. The inquiries are whether the live player at the respective game terminal has made a live game decision to hold cards in the shared hand. If not, then the method jumps to process step 1112 from decision step 1108 for the first gaming terminal, and to process step 1113 from decision step 1109 for the second gaming terminal. If cards are held, however, then the method continues to process step 1110 in the first gaming terminal and to process step 1111 in the second gaming terminal. Both of these process steps involve replicating the held cards to the new final hand at their respective game terminals. This replication to the final hands is what is shown in FIGS. 9B and 10B for held cards, for example.

The following process steps 1112 and 1113 involve sending the held card selections from the respective gaming terminal to the system server, after which process steps 1114 and 1115 involve receiving replacement cards for the cards that were not held in the initial shared hand at each respective gaming terminal. The replacement cards are then placed into the final hands at process steps 1116 and 1117, after which process steps 1118 and 1119 both involve evaluating the game outcomes and paying any winning awards. At the following decision steps 1120 and 1121 for the respective gaming terminals, an inquiry is made as to whether a new game is to be played. If so, then the method reverts to process step 1102 and repeats. If not, then the method ends at end step 1122.

Figure 12:
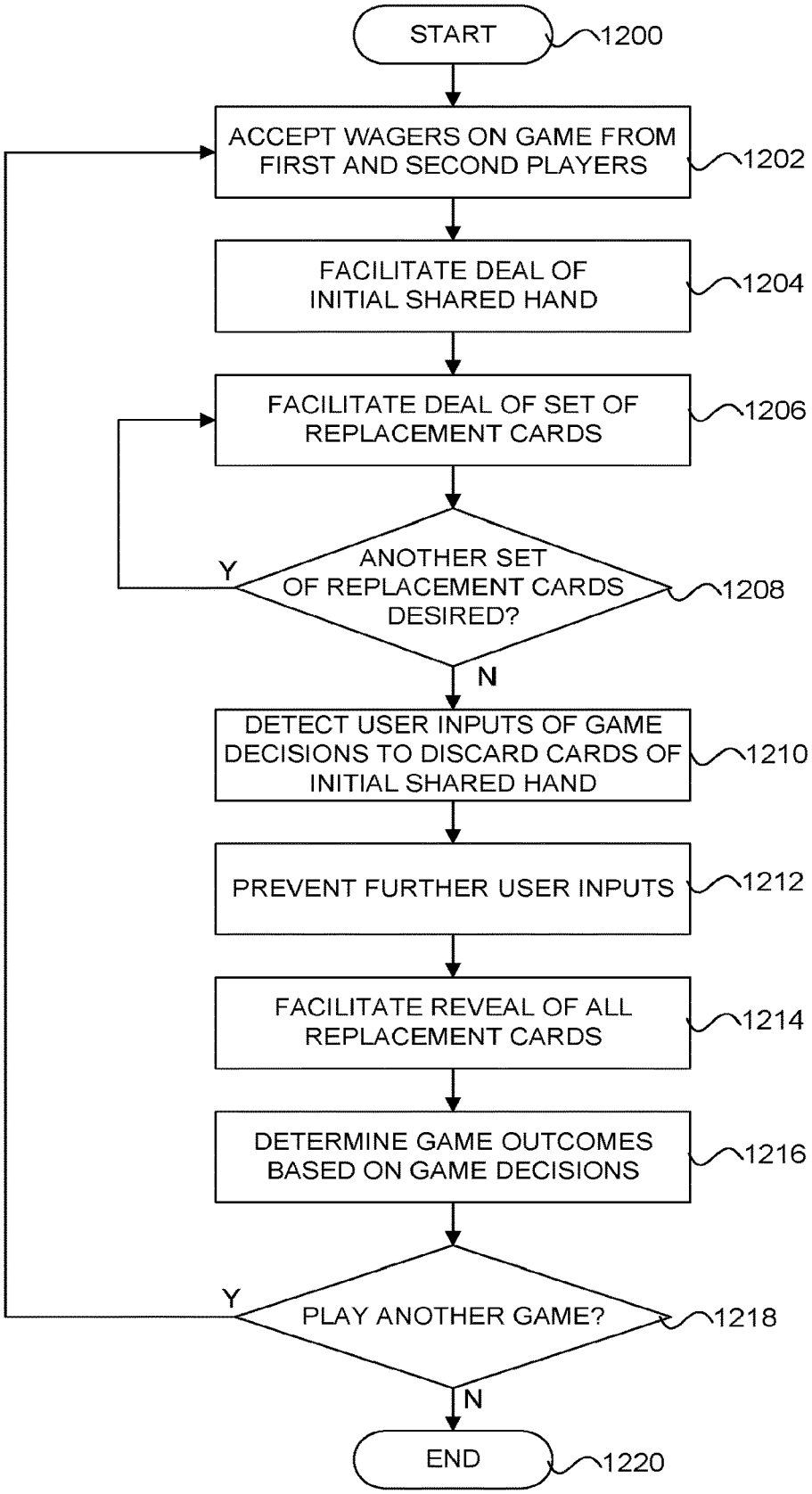
FIG. 12 illustrates a flowchart of an exemplary method performed by a controller for providing a live wager-based draw poker game at a physical electronic gaming table using physical playing cards according to various embodiments of the present disclosure.

FIG. 12 illustrates a flowchart of an exemplary method performed by a controller for providing a live wager-based draw poker game at a physical electronic gaming table using physical playing cards according to various embodiments of the present disclosure. The controller can be a game server, a table controller, or any other suitable controller device. In some embodiments, multiple controllers can perform the method, such as in the case of a table controller and a game or other system server. After a start step 1200, an initial process step 1202 can involve accepting wagers on the draw poker game from multiple live players, which can include at least first and second live players. At a following process step 1204 the deal of an initial shared hand can be facilitated, which initial shared hand can have five physical playing cards dealt at the physical electronic gaming table. The initial shared hand can be dealt face up, and can be shared by some or all of the multiple live players, such as the first live player and the second live player. At the next process step 1206, the deal of a set of replacement cards can be facilitated, which set of replacement cards can have five more physical playing cards, and which can be dealt from the same deck of cards as the initial shared hand. The set of replacement cards can also be dealt at the physical electronic gaming table, such as next to the initial shared hand, and the set of replacement cards can be dealt face down.

At a subsequent decision step 1208, an inquiry is made as to whether another set of replacement cards is desired. This can correspond to another possible play for the same player with respect to the same initial shared starting hand. If another set is desired, then step 1206 can be repeated until a sufficient number of sets of replacement cards are dealt. Where multiple sets of replacement cards are dealt, the overall deal of cards can resemble an array, such as that which is illustrated above for two sets of replacement cards. When no further set of replacement cards is desired, then the method moves to process step 1210, where user inputs of live game decisions are detected. The live game decisions can involve which cards in the initial shared hand are to be discarded. Alternatively, the live game decisions can involve which cards are to be held. In any event, the live game decisions of at least some of the multiple live game players can be different from each other, such as where the live game decisions of the first live player are different than the live game decisions of the second live player.

At the next process step 1212, further user inputs regarding live game decisions are prevented, such as decisions to discard or hold cards in the initial shared hand. Such a cutoff step is then followed by the next process step 1214, which involves facilitating a reveal of all replacement cards. This can involve turning over the five physical playing cards dealt face down for each set of replacement cards. Process step 1216 then involves determining game outcomes based on the different live game decisions made. This can be, for example, determining a first outcome for the first player and a second outcome for the second player based on the different live game decisions, with the first outcome being different than the second outcome. Depending upon the different game outcomes, one player may win an award while the other may not. Alternatively, both players may win awards, with one award possibly being bigger than the other award. It is also possible for neither player to win an award based on the different live game decisions that each player made. At a following decision step 1218, an inquiry is made as to whether another game is to be played. If so, then the entire method is repeated starting with process step 1202. If not, then the method ends at end step 1220.

Again, the device functioning as a gaming terminal can be a third party device, such as that which is owned by the player or associate, or can be a device that is owned or operated by the casino or other host establishment. Such a device can be a portable device, or any other suitable electronic device. Suitable modules, apps, programs, and/or other components can be used to facilitate such use, which can include verification and debiting capabilities with respect to a player balance on his or her separate third party device.

For the foregoing flowcharts and methods, it will be readily appreciated that not every method step provided is always necessary, and that further steps not set forth herein may also be included. For example, added steps may involve code generation, error detection, and alert provisions. Also, further steps to involve player tracking and recordation of data may be added. Furthermore, the exact order of steps may be altered as desired, and some steps may be performed simultaneously.

It should be understood that the devices, systems and methods described herein may be adapted and configured to function independently or may also interact with other systems or applications, such as for example, a casino management system or player tracking system. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the disclosure may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the disclosure so long as players and operators thereof are provided with useful access thereto or the opportunity to play the game as described herein.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A gaming table system, comprising:

one or more electronic gaming tables configured to provide live wager-based table games having a live dealer and physical game items, each of the one or more electronic gaming tables including a physical surface adapted for play of the live wager-based table games, a table controller adapted to control electronic gaming table functions, and a table communication interface coupled to the table controller and adapted to facilitate communications between the table controller and one or more other gaming table system components;

a plurality of gaming terminals, each of the plurality of gaming terminals including a terminal controller configured to facilitate play by a live player thereat of the live wager-based table games and a terminal communication interface coupled to the terminal controller and adapted to facilitate communications between the terminal controller and one or more other gaming table system components;

a system server located remotely from and in communication with the one or more electronic gaming tables and the plurality of gaming terminals, the system server configured to facilitate provision of the live wager-based table games; and a database coupled to the system server, wherein said gaming table system is configured to administer a first live table game involving an initial shared hand that is shared by multiple live players playing the first live table game, wherein said gaming table system is configured to administer an additional predetermined number of playing cards to provide a first replacement set of playing cards for potential replacement of the playing cards in the initial shared hand, the predetermined number of playing cards based on a wager;

wherein the first replacement set of playing cards are provided prior to any live game decisions made by the multiple live players, wherein each of the multiple live players are permitted to input different live game decisions independently regarding discarding physical playing items from the initial shared hand, wherein outcomes of the first live table game include final hands that vary depending upon the different live game decisions made by each of the multiple live players, and wherein the system server is configured to store in the database game play transactions for each of the one or more electronic gaming tables.

2. The gaming table system of claim 1, wherein the table controller for each of the one or more electronic gaming tables collects data from each of the plurality of gaming terminals, and wherein the collected data is provided to the system server for server processing.

3. The gaming table system of claim 2, wherein the server processing includes determining the game play transactions and storing the determined game play transactions in the database.

4. The gaming table system of claim 3, wherein each of the plurality of gaming terminals include a display, and wherein at least a portion of the determined game play transactions is displayed on the display of at least one of the gaming terminals.

5. The gaming table system of claim 2, wherein the server processing includes determining game state for games operating at the one or more electronic gaming tables according to game rules, and causing storage of the game states.

6. The gaming table system of claim 2, wherein the server processing includes resolving player hands and/or crediting or debiting player accounts.

7. The gaming table system of claim 1, wherein the initial shared hand includes an initial set of playing cards, and wherein the initial set of playing cards are provided prior to any live game decisions made by the multiple live players.

8. The gaming table system of claim 7, wherein the table controller for each of the one or more electronic gaming tables collects data from each of the plurality of gaming terminals, and wherein the collected data is provided to the system server for processing to determine the game play transactions and storing the determined game play transactions in the database.

9. The gaming table system of claim 1, wherein each of the multiple live players is permitted to play the initial shared hand for multiple different plays with each different play resulting in a different final hand.

10. The gaming table system of claim 9, wherein the table controller for each of the one or more electronic gaming tables collects data from each of the plurality of gaming terminals, and wherein the collected data is provided to the system server for processing to determine the game play transactions and storing the determined game play transactions in the database.

11. The gaming table system of claim 10, wherein each of the plurality of gaming terminals include a display, and wherein at least a portion of the determined game play transactions is displayed on the display of at least one of the gaming terminals.

12. The gaming table system of claim 1, wherein the discarded physical items from the initial shared hand include playing cards, and wherein the discarded physical items are replaced with similar replacement physical items to form a final hand.

13. The gaming table system of claim 12, wherein a similar replacement physical item is provided for each physical item that may be discarded from the initial shared hand.

14. The gaming table system of claim 7, wherein the first live table game is draw poker, and wherein the first replacement set of playing cards is a set of an additional five physical playing cards, and wherein provision of the first live table game involves dealing five physical playing cards face up to form the initial shared hand and the additional five physical playing cards are dealt face down.

15. The gaming table system of claim 14, wherein each of the additional five physical playing cards dealt face down correspond to a specific face up card from the initial set of playing cards of the initial shared hand.

16. The gaming table system of claim 14, wherein provision of the first live table game further involves dealing five more physical playing cards face down to provide a second set of replacement cards for the cards in the initial shared hand, and wherein the dealing of all fifteen physical playing cards takes place prior to any live game decisions made by the multiple live players.

17. The gaming table system of claim 16, wherein at least one of the plurality of gaming terminals provides a graphical representation of the initial shared hand, accepts a user input regarding discarding physical playing cards from the initial shared hand, and provides a graphical representation of the first set of replacement cards that replicates the non-discarded playing cards from the initial shared hand onto respective cards from the first set of replacement cards.

18. The gaming table system of claim 1, wherein said system server is further coupled to a player tracking system and configured to provide play data of one or more of the multiple live players regarding the play of the first live table game.

19. The gaming table system of claim 1, wherein the electronic gaming table comprises at least one display, and wherein at least a portion of the game play transactions is displayed on the display.

20. A gaming table system, comprising:

one or more electronic gaming tables configured to provide live wager-based table games having a live dealer and physical game items, each of the one or more electronic gaming tables including a physical surface adapted for play of the live wager-based table games, a table controller adapted to control electronic gaming table functions, and a table communication interface coupled to the table controller and adapted to facilitate communications between the table controller and one or more other gaming table system components;

a plurality of gaming terminals, each of the plurality of gaming terminals including a terminal controller configured to facilitate play by a live player thereat of the live wager-based table games and a terminal communication interface coupled to the terminal controller and adapted to facilitate communications between the terminal controller and one or more other gaming table system components;

a system server located remotely from and in communication with the one or more electronic gaming tables and the plurality of gaming terminals, the system server configured to facilitate provision of the live wager-based table games; and a database coupled to the system server, wherein said gaming table system is configured to administer a first live table game involving an initial shared hand that is shared by multiple live players playing the first live table game, wherein said gaming table system is configured to administer an additional predetermined number of playing cards to provide a first replacement set of playing cards for potential replacement of the playing cards in the initial shared hand;

wherein the first replacement set of playing cards are provided prior to any live game decisions made by the multiple live players, wherein each of the multiple live players are permitted to input different live game decisions independently regarding discarding physical playing items from the initial shared hand, wherein outcomes of the first live table game include final hands that vary depending upon the different live game decisions made by each of the multiple live players, and wherein the system server is configured to store in the database game history information for each of the one or more electronic gaming tables.

* * * * *